US007924249B2

(12) United States Patent
Nathan et al.

(10) Patent No.: US 7,924,249 B2
(45) Date of Patent: Apr. 12, 2011

(54) METHOD AND SYSTEM FOR LIGHT EMITTING DEVICE DISPLAYS

(75) Inventors: Arokia Nathan, Waterloo (CA); G. Reza Chaji, Waterloo (CA)

(73) Assignee: Ignis Innovation Inc., Kitchener, Ontario (CA)

( * ) Notice: Subject to any disclaimer, the term of this patent is extended or adjusted under 35 U.S.C. 154(b) by 899 days.

(21) Appl. No.: 11/673,512

(22) Filed: Feb. 9, 2007

(65) Prior Publication Data

US 2007/0195020 A1 Aug. 23, 2007

(30) Foreign Application Priority Data

Feb. 10, 2006 (CA) ..... 2536398
May 18, 2006 (CA) ..... 2547671
Nov. 27, 2006 (CA) ..... 2569156

(51) Int. Cl.
*G09G 3/30* (2006.01)

(52) U.S. Cl. ..... 345/78

(58) Field of Classification Search ..... 345/76–80
See application file for complete search history.

(56) References Cited

U.S. PATENT DOCUMENTS 4,354,162 A 10/1982 Wright
5,589,847 A 12/1996 Lewis
5,670,973 A 9/1997 Bassetti et al.
5,748,160 A 5/1998 Shieh et al.
5,815,303 A 9/1998 Berlin
6,097,360 A 8/2000 Holloman
6,259,424 B1 7/2001 Kurogane
6,288,696 B1 9/2001 Holloman
6,320,325 B1 11/2001 Cok et al.
6,414,661 B1 7/2002 Shen et al.
6,580,657 B2 6/2003 Sanford et al.
6,594,606 B2 7/2003 Everitt
6,618,030 B2 9/2003 Kane et al.
6,687,266 B1 2/2004 Ma et al.
6,690,344 B1 2/2004 Takeuchi et al.
6,693,388 B2 2/2004 Oomura
6,720,942 B2 4/2004 Lee et al.
6,738,035 B1 5/2004 Fan
6,771,028 B1 8/2004 Winters
6,777,712 B2 8/2004 Sanford et al.
6,806,638 B2 10/2004 Lin et al.

(Continued)

FOREIGN PATENT DOCUMENTS

CA 1294034 1/1992

(Continued)

OTHER PUBLICATIONS

European Search Report for European Application No. EP 07710608.6 dated Mar. 19, 2010 (7 pages).

(Continued)

*Primary Examiner* — Regina Liang
*Assistant Examiner* — Tom V Sheng
(74) *Attorney, Agent, or Firm* — Nixon Peabody LLP

(57) ABSTRACT

A method and system for light emitting device displays is provided. The system includes one or more pixels, each having a light emitting device, a drive transistor for driving the light emitting device, and a switch transistor for selecting the pixel; and a circuit for monitoring and extracting the change of the pixel to calibrate programming data for the pixel. Programming data is calibrated using the monitoring result.

20 Claims, 38 Drawing Sheets

U.S. PATENT DOCUMENTS

| | | | | |
|---|---|---|---|---|
| 6,809,706 | B2 | 10/2004 | Shimoda | |
| 6,909,419 | B2 | 6/2005 | Zavracky et al. | |
| 6,937,215 | B2 | 8/2005 | Lo | |
| 6,943,500 | B2 | 9/2005 | LeChevalier | |
| 6,995,510 | B2 | 2/2006 | Murakami et al. | |
| 6,995,519 | B2 | 2/2006 | Arnold et al. | |
| 7,027,015 | B2 | 4/2006 | Booth, Jr. et al. | |
| 7,034,793 | B2 | 4/2006 | Sekiya et al. | |
| 7,106,285 | B2 | 9/2006 | Naugler | |
| 7,274,363 | B2 | 9/2007 | Ishizuka et al. | |
| 7,321,348 | B2 * | 1/2008 | Cok et al. | 345/82 |
| 7,502,000 | B2 * | 3/2009 | Yuki et al. | 345/77 |
| 7,535,449 | B2 * | 5/2009 | Miyazawa | 345/92 |
| 7,554,512 | B2 | 6/2009 | Steer | |
| 7,619,594 | B2 * | 11/2009 | Hu | 345/76 |
| 7,619,597 | B2 * | 11/2009 | Nathan et al. | 345/82 |
| 2002/0084463 | A1 | 7/2002 | Sanford et al. | |
| 2002/0101172 | A1 | 8/2002 | Bu | |
| 2002/0158823 | A1 | 10/2002 | Zavracky et al. | |
| 2002/0186214 | A1 | 12/2002 | Siwinski | |
| 2002/0190971 | A1 | 12/2002 | Nakamura et al. | |
| 2002/0195967 | A1 | 12/2002 | Kim et al. | |
| 2003/0020413 | A1 | 1/2003 | Oomura | |
| 2003/0030603 | A1 | 2/2003 | Shimoda | |
| 2003/0076048 | A1 | 4/2003 | Rutherford | |
| 2003/0151569 | A1 | 8/2003 | Lee et al. | |
| 2003/0179626 | A1 | 9/2003 | Sanfod et al. | |
| 2004/0066357 | A1 | 4/2004 | Kawasaki | |
| 2004/0135749 | A1 | 7/2004 | Kondakov et al. | |
| 2004/0183759 | A1 | 9/2004 | Stevenson et al. | |
| 2004/0189627 | A1 | 9/2004 | Shirasaki et al. | |
| 2004/0257355 | A1 | 12/2004 | Naugler | |
| 2005/0110420 | A1 | 5/2005 | Arnold et al. | |
| 2005/0140610 | A1 | 6/2005 | Smith et al. | |
| 2005/0145891 | A1 | 7/2005 | Abe | |
| 2005/0156831 | A1 * | 7/2005 | Yamazaki et al. | 345/76 |
| 2006/0038758 | A1 | 2/2006 | Routley et al. | |
| 2006/0232522 | A1 | 10/2006 | Roy et al. | |
| 2007/0080908 | A1 * | 4/2007 | Nathan et al. | 345/77 |
| 2007/0182671 | A1 | 8/2007 | Nathan et al. | |

FOREIGN PATENT DOCUMENTS

| | | | |
|---|---|---|---|
| CA | 2368386 | | 9/1999 |
| CA | 2432530 | | 7/2002 |
| CA | 2498136 | | 3/2004 |
| CA | 2522396 | | 11/2004 |
| CA | 2443206 | | 3/2005 |
| CA | 2472671 | | 12/2005 |
| CA | 2567076 | | 1/2006 |
| EP | 1 194 013 | | 3/2002 |
| EP | 1 335 430 | A1 | 8/2003 |
| EP | 1 381 019 | | 1/2004 |
| EP | 1381019 | | 1/2004 |
| EP | 1 521 203 | A2 | 4/2005 |
| JP | 10-254410 | | 9/1998 |
| JP | 2002-278513 | | 9/2002 |
| JP | 2003-076331 | | 3/2003 |
| JP | 2003-308046 | | 10/2003 |
| WO | 9948079 | | 9/1999 |
| WO | 01/27910 | A1 | 4/2001 |
| WO | 03/034389 | | 4/2003 |
| WO | 03/063124 | | 7/2003 |
| WO | 2004/003877 | | 1/2004 |
| WO | 2004/034364 | | 4/2004 |
| WO | 2005/022498 | | 3/2005 |
| WO | 2005/055185 | | 6/2005 |
| WO | 2006/063448 | | 6/2006 |
| WO | WO 2006/063448 | | 6/2006 |

OTHER PUBLICATIONS

Alexander et al.: "Pixel circuits and drive schemes for glass and elastic AMOLED displays"; dated Jul. 2005 (9 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "An Enhanced and Simplified Optical Feedback Pixel Circuit for AMOLED Displays"; dated Oct. 2006.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "eUTDSP: a design study of a new VLIW-based DSP architecture"; dated May 2003 (4 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost Stable a-Si:H AMOLED Display for Portable Applications"; dated Jun. 2006 (4 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Jafarabadiashtiani et al.: "A New Driving Method for a-Si AMOLED Displays Based on Voltage Feedback"; dated 2005 (4 pages).
Joon-Chul Goh et al., "A New a-Si:H Thin-Film Transistor Pixel Circuit for Active-Matrix Organic Light-Emitting Diodes", IEEE Electron Device Letters, vol, 24, No. 9, Sep. 2003, pp. 583-585.
Lee et al.: "Ambipolar Thin-Film Transistors Fabricated by PEVCD Nanocrystalline Silicon"; dated 2006 (6 pages).
Matsueda y et al.: "35.1: 2.5-in. AMOLED with Integrated 6-bit Gamma Compensated Digital Data Driver"; dated May 2004.
Arokia Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan et al.: "Backplane Requirements for Active Matrix Organic Light Emitting Diode Displays"; dated 2006 (16 pages).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated 2006 (4 pages).
Philipp: "Charge transfer sensing" Sensor Review, vol. 19, No. 2, Dec. 31, 1999, 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.

* cited by examiner

30

370

METHOD AND SYSTEM FOR LIGHT EMITTING DEVICE DISPLAYS

FIELD OF INVENTION

The present invention relates to display technologies, more specifically to a method and system for light emitting device displays

BACKGROUND OF THE INVENTION

Electro-luminance displays have been developed for a wide variety of devices, such as cell phones. In particular, active-matrix organic light emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having all organic light emitting diode (OLED) and backplane electronics arranged in the array of rows and columns. Since the OLED is a current driven device, the pixel circuit of the AMOLED should be capable of providing an accurate and constant drive current.

There is a need to provide a method and system that is capable of providing constant brightness with high accuracy.

SUMMARY OF THE INVENTION

It is an object of the invention to provide a method and system that obviates or mitigates at least one of the disadvantages of existing systems.

According to an aspect of the present invention there is provided a display system including one or more pixels. Each pixel includes a light emitting device, a drive transistor for driving the light emitting device, and a switch transistor for selecting the pixel. The display system includes a circuit for monitoring and extracting the change of the pixel to calibrate programming data for the pixel.

According to another aspect of the present invention there is provided a method of driving the display system. The display system includes one or more than pixels. The method includes the steps of at an extraction cycle, providing an operation signal to the pixel, monitoring a node in the pixel, extracting the aging of the pixel based on the monitoring result; and at a programming cycle, calibrating programming data based on the extraction of the aging of the pixel and providing the programming data to the pixel.

BRIEF DESCRIPTION OF THE DRAWINGS

These and other features of the invention will become more apparent from the following description in which reference is made to the appended drawings wherein.

DETAILED DESCRIPTION

Embodiments of the present invention are described using a pixel circuit having a light emitting device (e.g., an organic light emitting diode (OLED)), and a plurality of transistors. The transistors in the pixel circuit or in display systems in the embodiments below may be n-type transistors, p-type transistors or combinations thereof The transistors in the pixel circuit or in the display systems in the embodiments below may be fabricated using amorphous silicon, nano/micro crystalline silicon, poly silicon, organic semiconductors technologies (e.g. organic TFT), NMOS/PMOS technology or CMOS technology (e.g. MOSFET). A display having the pixel circuit may be a single color, multi-color or a fully color display, and may include one or more than one electroluminescence (EL) element (e.g., organic EL). The display may be an active matrix light emitting display (e.g., AMOLED). The display may be used in TVs, DVDs, personal digital assistants (PDAs), computer displays, cellular phones, or other applications. The display may be a flat panel.

In the description below, "pixel circuit" and "pixel" are used interchangeably. In the description below, "signal" and "line" may be used interchangeably. In the description below, the terms "line" and "node" may be used interchangeably. In the description, the terms "select line" and "address line" may be used interchangeably. In the description below, "connect (or connected)"and "couple (or coupled)" may be used interchangeably, and may he used to indicate that two or more elements are directly or indirectly in physical or electrical contact with each other. In the description, a pixel (circuit) in the ith row and the jth column may be referred to as a pixel (circuit) at position (i, j).

Figure 1:
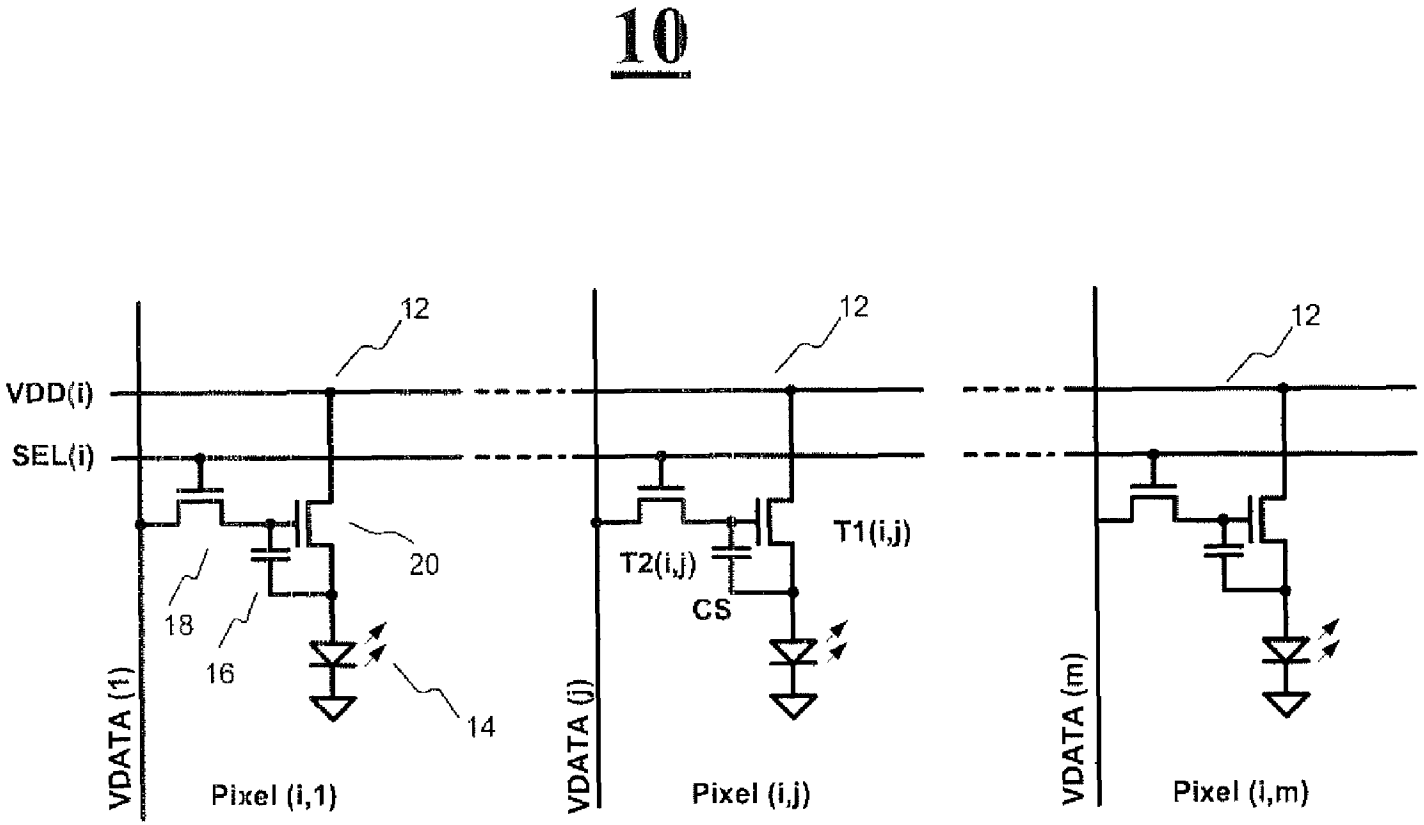
FIG. 1 illustrates an example of a pixel array having a 2-transistor (2T) pixel circuit to which a pixel operation technique in accordance with an embodiment of the present invention is suitably applied.

FIG. 1 illustrates an example of a pixel array having a 2-transistor (2T) pixel circuit to which a pixel operation technique in accordance with an embodiment of the present invention is suitably applied. The pixel array 10 of FIG. 1 includes a plurality of pixel circuits 12 arranged in "n" rows and "m" columns. In FIG. 1, the pixel circuits 12 in the ith row are shown.

Each pixel circuit 12 includes an OLED 14, a storage capacitor 16, a switch transistor 18, and a drive transistor 20. The drain terminal of the drive transistor 20 is connected to a power supply line for the corresponding row (e.g., VDD(i)), and the source terminal of the drive transistor 20 is connected to the OLED 14. One terminal of the switch transistor 18 is connected to a data line for the corresponding column (e.g., VDATA(1), . . . , or VDATA (m)), and the other terminal of the switch transistor 18 is connected to the gate terminal of the drive transistor 20. The gate terminal of the switch transistor 18 is connected to a select line for the corresponding row (e.g., SEL(i)). One terminal of the storage capacitor 16 is connected to the gate terminal of the drive transistor 20, and the other terminal of the storage capacitor 16 is connected to the OLED 14 and the source terminal of the drive transistor 20. The OLED 14 is connected between a power supply (e.g., ground) and the source terminal of the drive transistor 20. The aging of the pixel circuit 12 is extracted by monitoring the voltage of the power supply line VDD(i), as described below.

Figure 2:
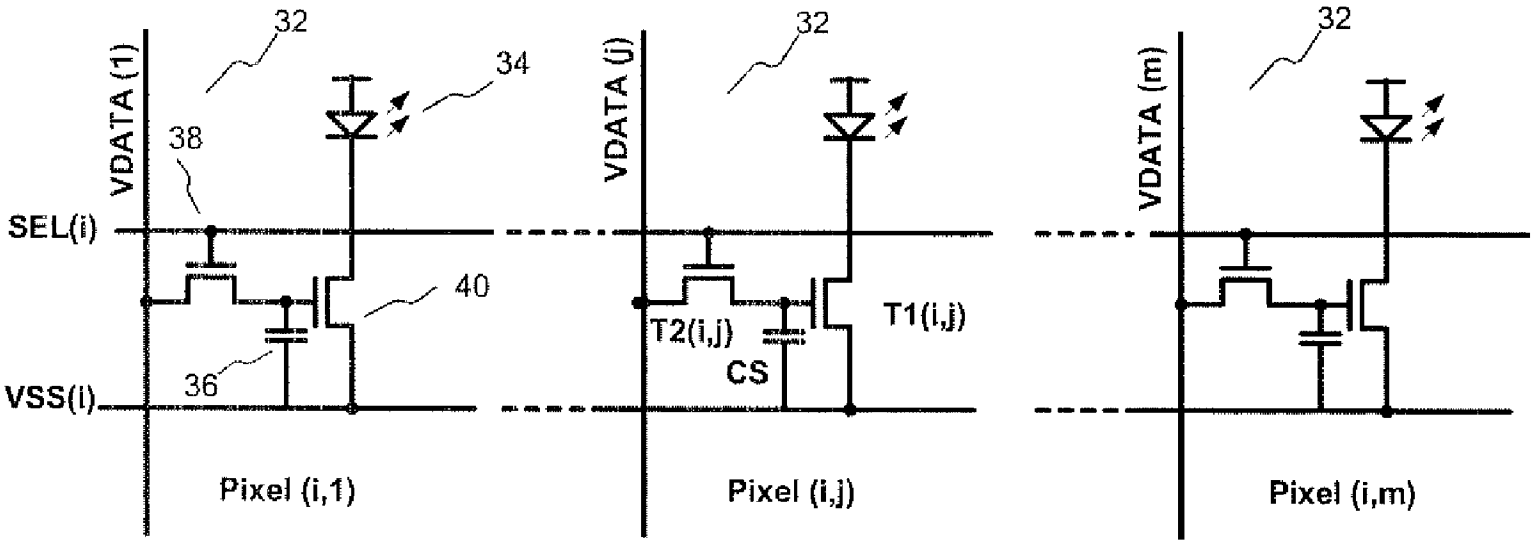
FIG. 2 illustrates another example of a pixel array having a 2T pixel circuit to which the pixel operation technique associated with FIG. 1 is suitably applied.

FIG. 2 illustrates another example of a pixel array having a 2T pixel circuit to which the pixel operation technique associated with FIG. 1 is suitably applied. The pixel array 30 of FIG. 2 is similar to the pixel array 10 of FIG. 1. The pixel circuit array 30 includes a plurality of pixel circuits 32 arranged in "n" rows and "m" columns. In FIG. 2, the pixel circuits 32 in the ith row are shown.

Each pixel circuit 32 includes an OLED 34, a storage capacitor 36, a switch transistor 38, and a drive transistor 40. The OLED 34 corresponds to the OLED 14 of FIG. 1. The storage capacitor 36 corresponds to the storage capacitor 16 of FIG. 1. The switch transistor 38 corresponds to the switch transistor 18 of FIG. 1. The drive transistor 40 corresponds to the drive transistor 20 of FIG. 1.

The source terminal of the drive transistor 40 is connected to a power supply line for the corresponding row (e.g., VSS (i)), and the drain terminal of the drive transistor 40 is connected to the OLED 34. One terminal of the switch transistor 38 is connected to a data line for the corresponding column (e.g., VDATA(1), . . . , or VDATA (m)), and the other terminal of the switch transistor 38 is connected to the gate terminal of the drive transistor 40. One terminal of the storage capacitor 34 is connected to the gate terminal of the drive transistor 40, and the other terminal of the storage capacitor 34 is connected to the corresponding power supply line (e.g., VSS(i)). The OLED 34 is connected between a power supply and the drain terminal of the drive transistor 40. The aging of the pixel circuit is extracted by monitoring the voltage of the power supply line VSS(i), as described below.

Figure 3A:
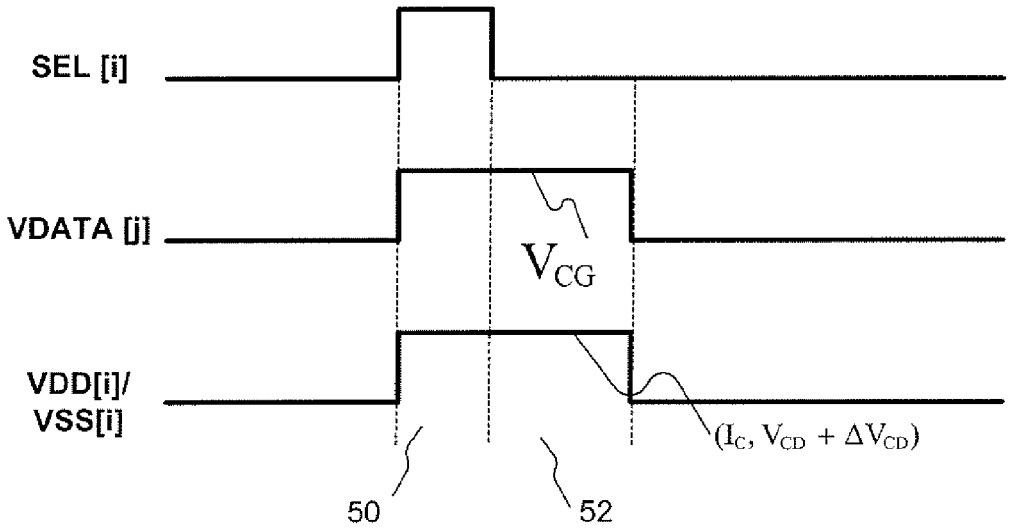
FIG. 3A illustrates an example of signal waveforms applied to the pixel circuits of FIGS. 1 and 2 during an extraction operation.
Figure 3B:
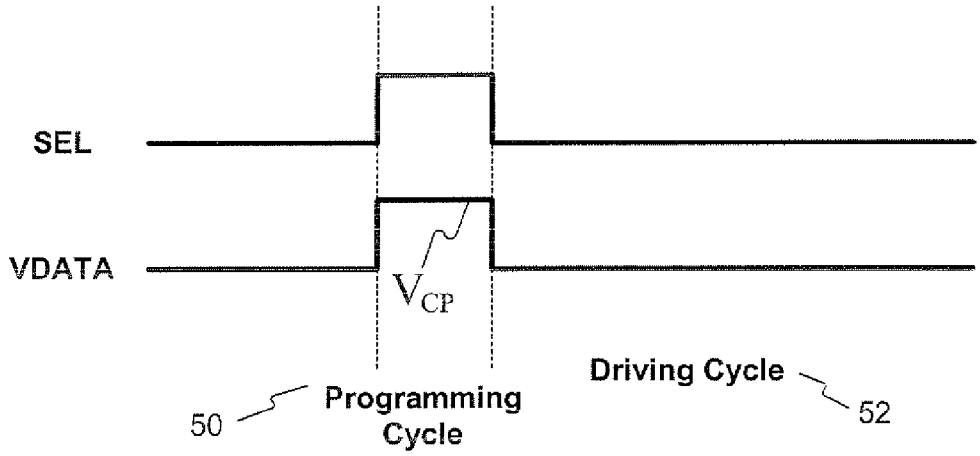
FIG. 3B illustrates an example of signal waveforms applied to the pixel circuits of FIGS. 1 and 2 during a normal operation.

FIG. 3A illustrates an example of signal waveforms applied to the pixel circuits of FIGS. 1 and 2 during an extraction operation. FIG. 3B illustrates an example of signal waveforms applied to the pixel circuits of FIGS. 1 and 2 during a normal operation. In FIG. 3A, VDD(i) is a power supply line/signal corresponding to VDD(i) of FIG. 1, and VSS(i) is a power supply line/signal corresponding to VSS(i) of FIG. 2. "Ic" is a constant current applied to VDD (i) of the pixel at position (i, j), which is being calibrated. The voltage generated on VDD (i) line as a result of the current Ic is ($V_{CD}+\Delta V_{CD}$) where $V_{CD}$ is the DC biasing point of the circuit and $\Delta V_{CD}$ is the amplified shift in the OLED voltage and threshold voltage of drive transistor (20 of FIG. 1 or 40 of FIG. 2).

Referring to FIGS. 1, 2 and 3A, the aging of the pixel at position (i, j) is extracted by monitoring the voltage of the power supply line (VDD (i) of FIG. 1 or VSS(i) of FIG. 2). The operation of FIG. 3A for the pixel at position (i, j) includes first and second extraction cycles 50 and 52. During the first extraction cycle 50, the gate terminal of the drive transistor (20 of FIG. 1 or 40 of FIG. 2) in the pixel at position (i, j) is charged to a calibration voltage $V_{CG}$. This calibration voltage $V_{CG}$ includes the aging prediction, calculated based on the previous aging data, and a bias voltage. Also, the other pixel circuits in the ith row arc programmed to zero during the first extraction cycle.

During the second extraction cycle 52, SEL(i) goes to zero and so the gate voltage of the drive transistor (20 of FIG. 1 or 40 of FIG. 2) in the pixel at position (i, j) is affected by the dynamic effects such as charge injection and clock feed-through. During this cycle, the drive transistor (20 of FIG. 1 or 40 of FIG. 2) acts as an amplifier since it is biased with a constant current through the power supply line for the ith row (VDD(i) of FIG. 1 or VSS(i) of FIG. 2). Therefore, the effects of shift in the threshold voltage (VT) of the drive transistor (20 of FIG. 1 or 40 of FIG. 2) in the pixel at position (i, j) is amplified, and the voltage of the power supply line (VDD(i) of FIG. 1 or VSS(i) of FIG. 2) changes accordingly. Therefore, this method enables extraction of very small amount of VT shift resulting in highly accurate calibration. The change in VDD (i) or VSS(i) is monitored. Then, the change(s) in VDD(i) or VSS(i) is used for calibration of programming data.

Referring to FIGS. 1, 2 and FIG. 3B, the normal operation for the pixel at position (i, j) includes a programming cycle 62 and a driving cycle 64. During the programming cycle 62, the gate terminal of the drive transistor (20 of FIG. 1 or 40 of FIG. 2) in the pixel at position (i, j) is charged to a calibrated programming voltage $V_{CP}$ using the monitoring result (e.g., change(s) of VDD or VSS). This voltage Vcp is defined by the gray scale and the aging of the pixel (e.g., it is the sum of a voltage related to a gray scale and the aging extracted during the calibration cycles). Next, during the driving cycle 64, the select line SEL(i) is low and the drive transistor (20 of FIG. 1 or 40 of FIG. 2) in the pixel at position (i, j) provides current to the OLED (14 of FIG. 1 or 34 of FIG. 2) in the pixel at position (i, j).

Figure 4:
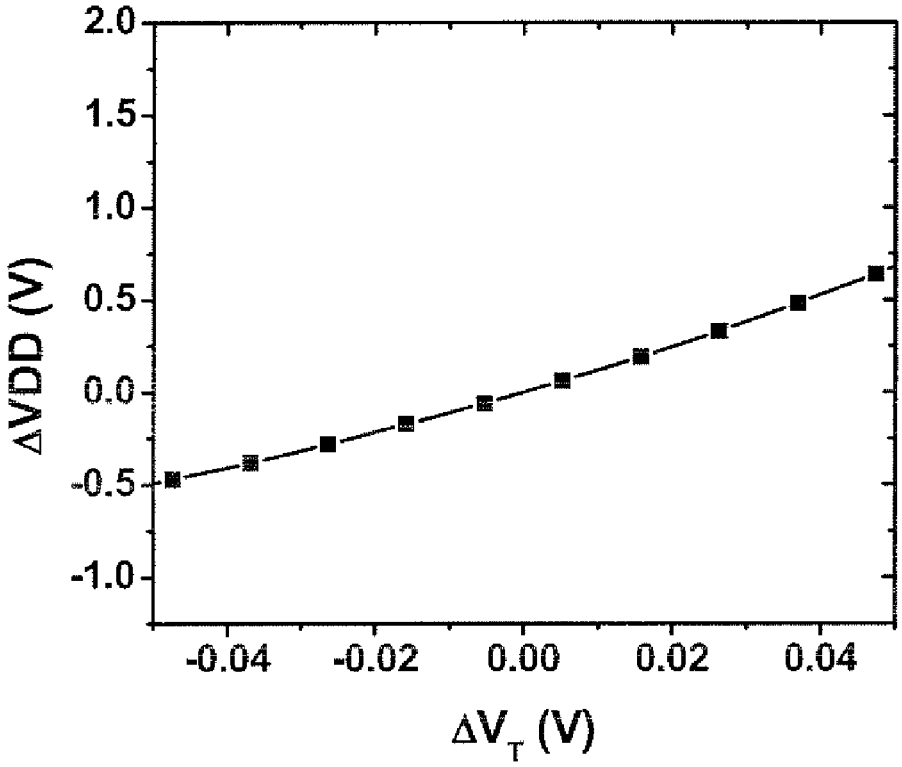
FIG. 4 illustrates the effect of shift in the threshold voltage of a drive transistor on the voltage of VDD during the extraction cycles of FIG. 3A.

FIG. 4 illustrates the effect of shift in the threshold voltage of the drive transistor (VT shift) on the voltage of the power supply line VDD during the extraction cycles of FIG. 3A. It is apparent to one of ordinary skill in the art that the drive transistor can provide a reasonable gain so that makes the extraction of small VT shift possible.

Figure 5:
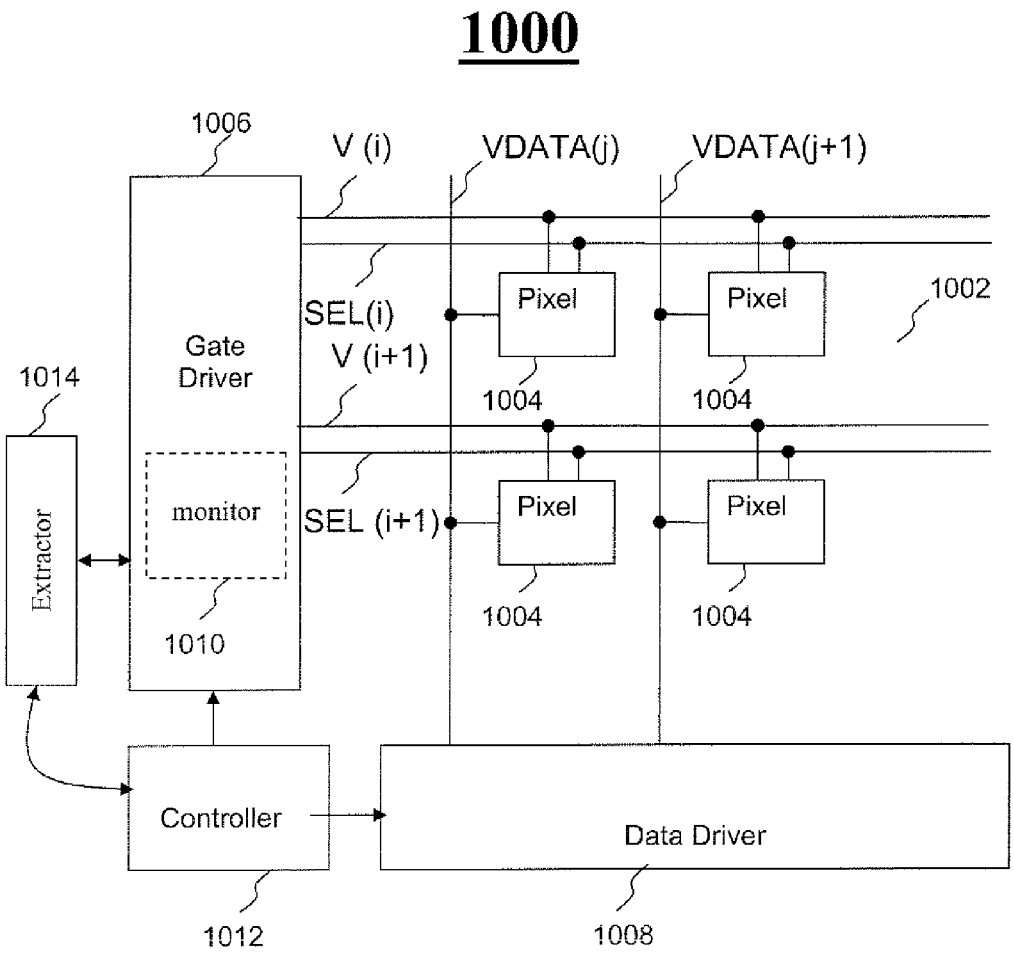
FIG. 5 illustrates an example of a display system having the pixel array of FIG. 1 or 2.

FIG. 5 illustrates an example of a display system having the pixel arrays of FIGS. 1 and 2, The display system 1000 of FIG. 5 includes a pixel array 1002 having a plurality of pixels 1004. In FIG. 5, four pixels 1004 are shown. However, the number of the pixels 1004 may vary in dependence upon the system design, and does not limited to four. The pixel 1004 may be the pixel circuit 12 of FIG. 1 or the pixel circuit 32 of FIG. 2. The pixel array 1002 is an active matrix light emitting display, and may form an AMOLED display.

SEL(k) (k=i, i+1) is a select line for selecting the kth row, and corresponds to SEL(i) of FIGS. 1 and 2. V(k) is a power supply line and corresponds to VDD(j) of FIG. 1 and VSS(j) of FIG. 2. VDATA(1) (l=j,j+1) is a data line and corresponds to one of VDATA (1), . . . VDATA(m) of FIGS. 1 and 2. SEL(k) and V(k) are shared between common row pixels in the pixel array 1002. VDATA(1) is shared between common column pixels in the pixel array 1002.

A gate driver 1006 drives SEL(k) and V(k). The gate driver 1006 includes an address driver for providing address signals to SEL (k). The gate driver 1006 includes a monitor 1010 for driving V(k) and monitoring the voltage of V(k). V(k) is appropriately activated for the operations of FIGS. 3A and 3B. A data driver 1008 generates a programming data and drives VDATA(1). Extractor block 1014 calculates the aging of the pixel based on the voltage generated on VDD(i). VDATA(1) is calibrated using the monitoring result (i.e., the change of the data line V(k)). The monitoring result may be provided to a controller 1012. The gate driver 1006, the controller 1012, the extractor 1014, or a combination thereof may include a memory for storing the monitoring result. The controller 1012 controls the drivers 1006 and 1008 and the extractor 1014 to drive the pixels 1004 as described above. The voltages $V_{CG}$, $V_{CP}$ of FIGS. 3A and 3B are generated using the column driver.

Figure 6:
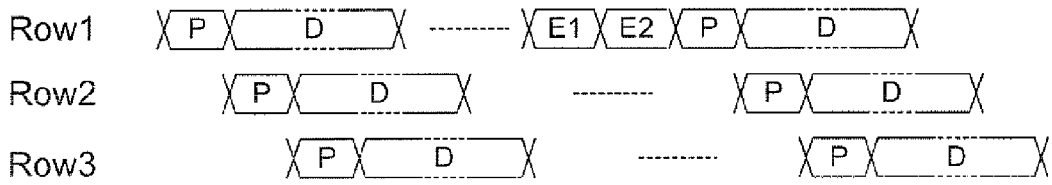
FIG. 6 illustrates an example of normal and extraction cycles for driving the pixel array of FIG. 5.

FIG. 6 illustrates an example of normal and extraction cycles for driving the pixel array 1002 of FIG. 5. In FIG. 67 each of ROWi (i=1, 2, . . . ) represents the ith row; "P" represents a programming cycle and corresponds to 60 of FIG. 3B; "D" represents a driving cycle and corresponds to 62 of FIG. 3B; "E1 " represents a first extraction cycle and corresponds to 50 of FIG. 3A; and "E2 " represents a second extraction cycle and corresponds to 52 of FIG. 3A. The extraction can happen at the end of each frame during the blanking time. During this time, the aging of several pixels can be extracted. Also, an extra frame can be inserted between several frames in which all pixels are OFF. During this frame, one can extract the aging of several pixels without affecting the image quality.

Figure 7:
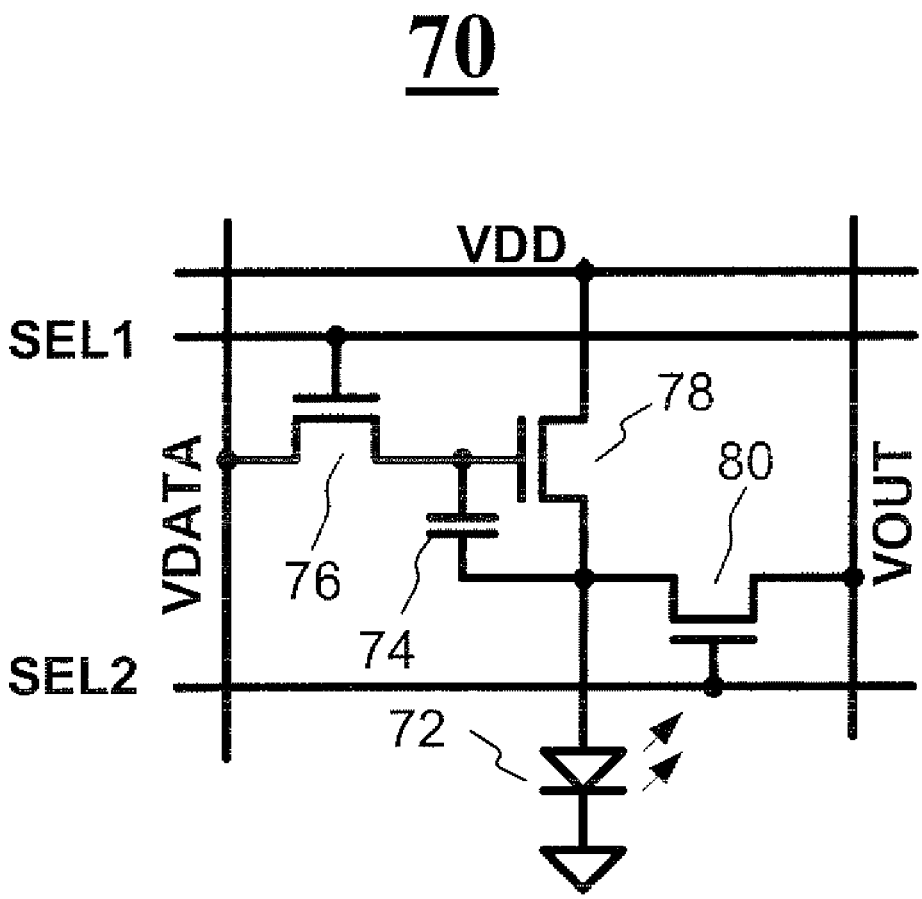
FIG. 7 illustrates an example of a 3-transistor (3T) pixel circuit to which a pixel operation technique in accordance with another embodiment of the present invention is suitably applied.

FIG. 7 illustrates an example of a 3-transistor (3T) pixel circuit to which a pixel operation technique in accordance with another embodiment of the present invention is suitably applied. The pixel circuit 70 of FIG. 7 includes an OLED 72, a storage capacitor 74, a switch transistor 76, and a drive transistor 78. The pixel circuit 70 forms an AMOLED display.

The drain terminal of the drive transistor 78 is connected to a power supply line VDD, and the source terminal of the drive transistor 78 is connected to the OLED 72. One terminal of the switch transistor 76 is connected to a data line VDATA, and the other terminal of the switch transistor 76 is connected to the gate terminal of the drive transistor 78. The gate terminal of the switch transistor 76 is connected to a first select line SEL1. One terminal of the storage capacitor 74 is connected to the gate terminal of the drive transistor 78, and the other terminal of the storage capacitor 74 is connected to the OLED 72 and the source terminal of the drive transistor 78.

A sensing transistor 80 is provided to the pixel circuit 70. The transistor 80 may be included in the pixel circuit 70. One terminal of the transistor 80 is connected to an output line VOUT, and the other terminal of the transistor 80 is connected to the source terminal of the drive transistor 78 and the OLED 72. The gate terminal of the transistor 80 is connected to a second select line SEL2.

The aging of the pixel circuit 70 is extracted by monitoring the voltage of the output line VOUT. In one example, VOUT may be provided separately from VDATA. In another example, VOUT may be a data line VDATA For a physically adjacent column (row). SEL1 is used for programming, while SEL1 and SEL2 are used for extracting pixel aging.

Figure 8:
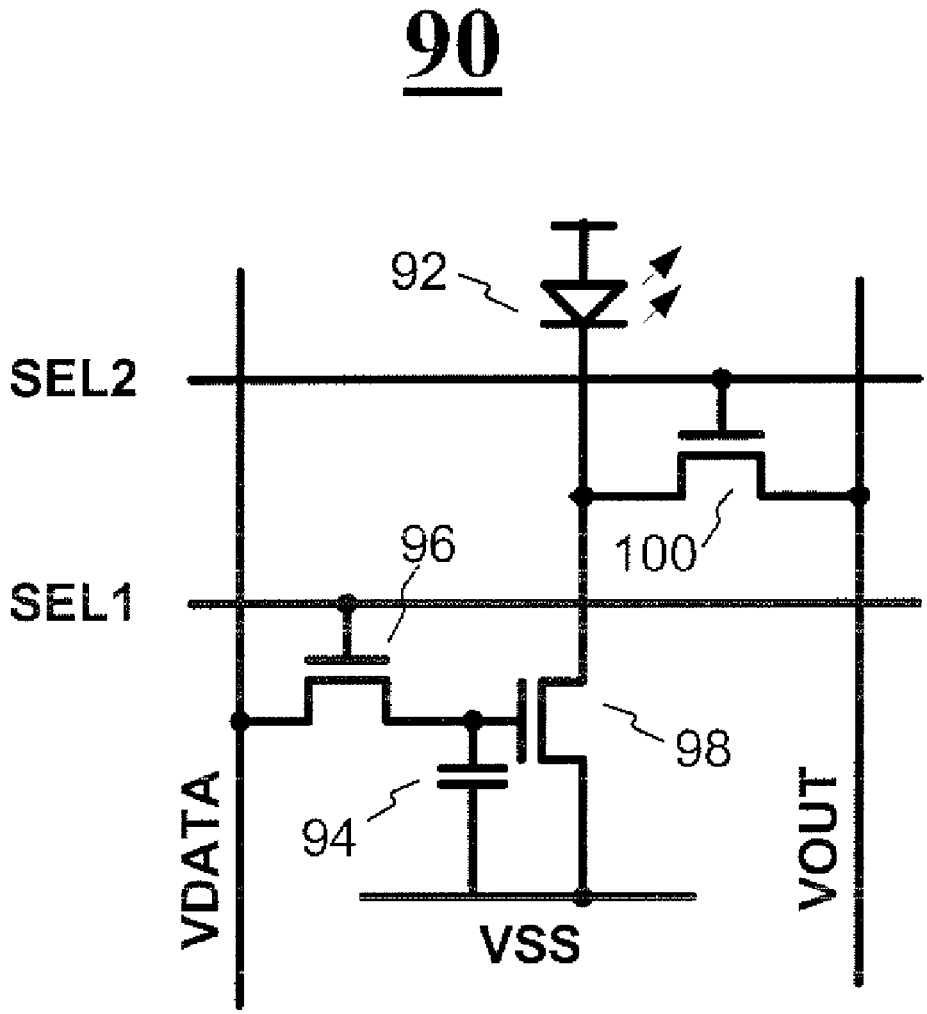
FIG. 8 illustrates another example of a 3T pixel circuit to which the pixel operation technique associated with FIG. 7 is suitably applied.

FIG. 8 illustrates another example of a 3T pixel circuit to which the pixel operation technique associated with FIG. 7 is suitably applied. The pixel circuit 90 of FIG. 8 includes an OLED 92, a storage capacitor 94, a switch transistor 96, and a drive transistor 98. The OLED 92 corresponds to the OLED 72 of FIG. 7. The storage capacitor 94 corresponds to the storage capacitor 74 of FIG. 7. The transistors 96 and 98 correspond to the transistors 76 and 78 of FIG. 7. The pixel circuit 90 forms an AMOLED display.

The source terminal of the drive transistor 98 is connected to a power supply line VSS, and the drain terminal of the drive transistor 98 is connected to the OLED 92. The switch transistor 96 is connected between a data line VDATA and the gate terminal of the drive transistor 98. The gate terminal of the switch transistor 96 is connected to a first select line SEL1. One terminal of the storage capacitor 94 is connected to the gate terminal of the drive transistor 98, and the other terminal of the storage capacitor 94 is connected to VSS.

A sensing transistor 100 is provided to the pixel circuit 90. The transistor 100 may be included in the pixel circuit 90. One terminal of the transistor 100 is connected to an output line VOUT, and the other terminal of the transistor 100 is connected to the drain terminal of the drive transistor 98 and the OLED 92. The gate terminal of the transistor 100 is connected to a second select line SEL2.

The aging of the pixel circuit 90 is extracted by monitoring the voltage of the output line VOUT. In one example, VOUT may be provided separately from VDATA. In another example, VOUT may be a data line VDATA for a physically adjacent column (row). SEL1 is used for programming, while SEL1 and SEL2 are used for extracting pixel aging.

Figure 9A:
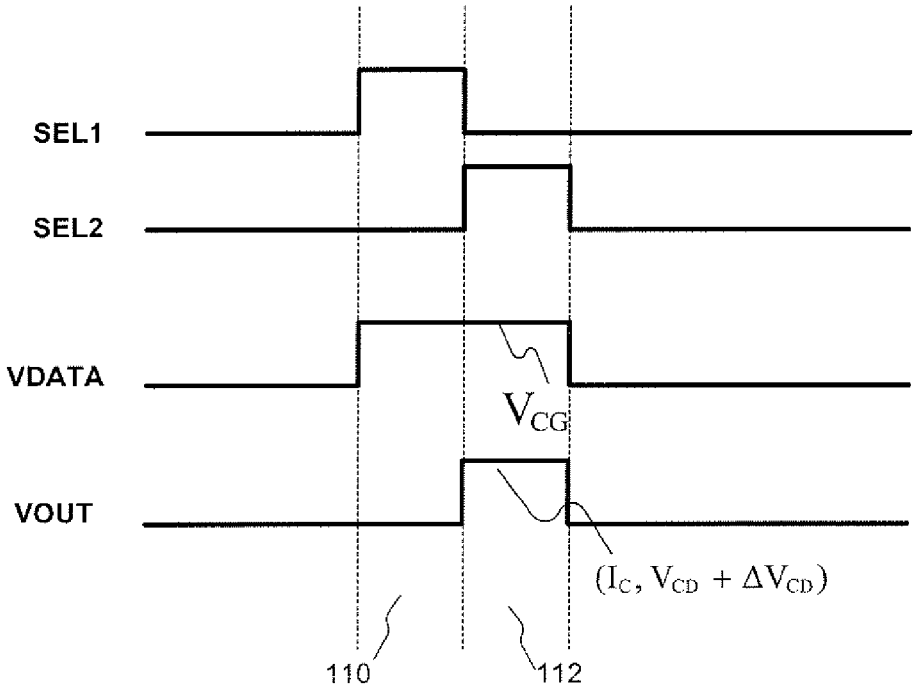
FIG. 9A illustrates an example of signal waveforms applied to the pixel circuits of FIGS. 7 and 8 during an extraction operation.
Figure 9B:
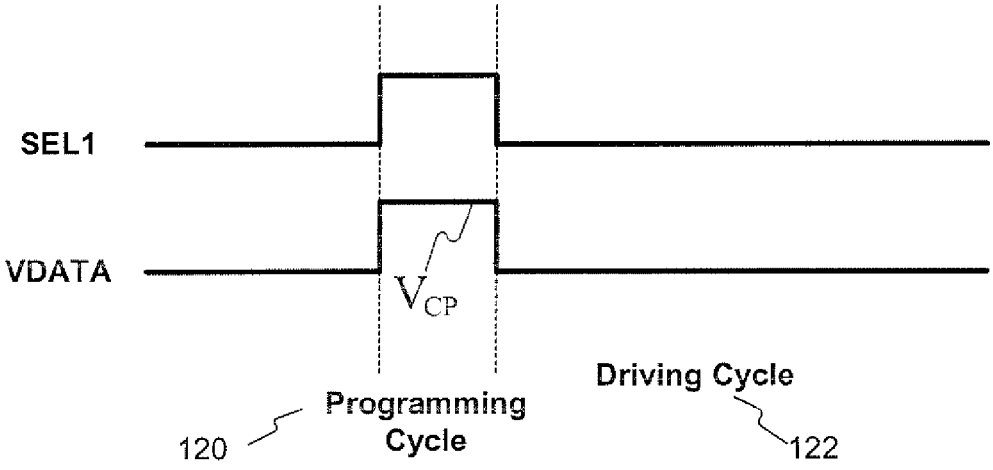
FIG. 9B illustrates an example of signal waveforms applied to the pixel circuits of FIGS. 7 and 8 during a normal operation.

FIG. 9A illustrates an example of signal waveforms applied to the pixel circuits of FIGS. 7 and 8 during an extraction operation. FIG. 9B illustrates an example of signal waveforms applied to the pixel circuits of FIGS. 7 and 8 during a normal operation.

Referring to 7, 8 and FIG. 9A, the extraction operation for the pixel at position (i, j) includes first and second extraction cycles 110 and 112. During the first extraction cycle 110, the gate terminal of the drive transistor (78 of FIG. 7 or 98 of FIG. 8) is charged to a calibration voltage $V_{CG}$. This calibration voltage $V_{CG}$ includes the aging prediction, calculated based on the previous aging data. During, the second extraction cycle 112, the first select line SEL1 goes to zero, and so the gate voltage of the drive transistor (78 of FIG. 7 or 98 of FIG. 8) is affected by the dynamic effects including the charge injection and clock feed-through. During the second extraction cycle 112, the drive transistor (78 of FIG. 7 or 98 of FIG. 8) acts as an amplifier since it is biased with a constant current (Ic) through VOUT. The voltage developed on VOUT as a result of current Ic applied to it is ($V_{CD}+\Delta V_{CD}$). Therefore, the aging of the pixel is amplified, and the voltage of the VOUT changes accordingly. Therefore, this method enables extraction of very small amount of voltage threshold (VT) shift resulting in highly accurate calibration. The change in VOUT is monitored. Then, the change(s) in VOUT is used for calibration of programming data.

Also, applying a current/voltage to the OLED during the extraction cycle, the voltage/current of the OLED can be extracted, and the system determines the aging factor of the OLED and uses it for more accurate calibration of the luminance data.

Referring to 7, 8 and 9B, the normal operation for the pixel at position (i, j) includes a programming cycle 120 and a driving cycle 122. During the programming cycle 120, the gate terminal of the drive transistor (78 of FIG. 7 or 98 of FIG. 8) is charged to a calibrated programming voltage $V_{CP}$ using the monitoring result (e.g., the changes of VOUT). Next, during the driving cycle 122, the select line SEL1 is low and the drive transistor (78 of FIG. 7 or 98 of FIG. 8) provides current to the OLED (72 of FIG. 7, or 92 of FIG. 8).

Figure 10:
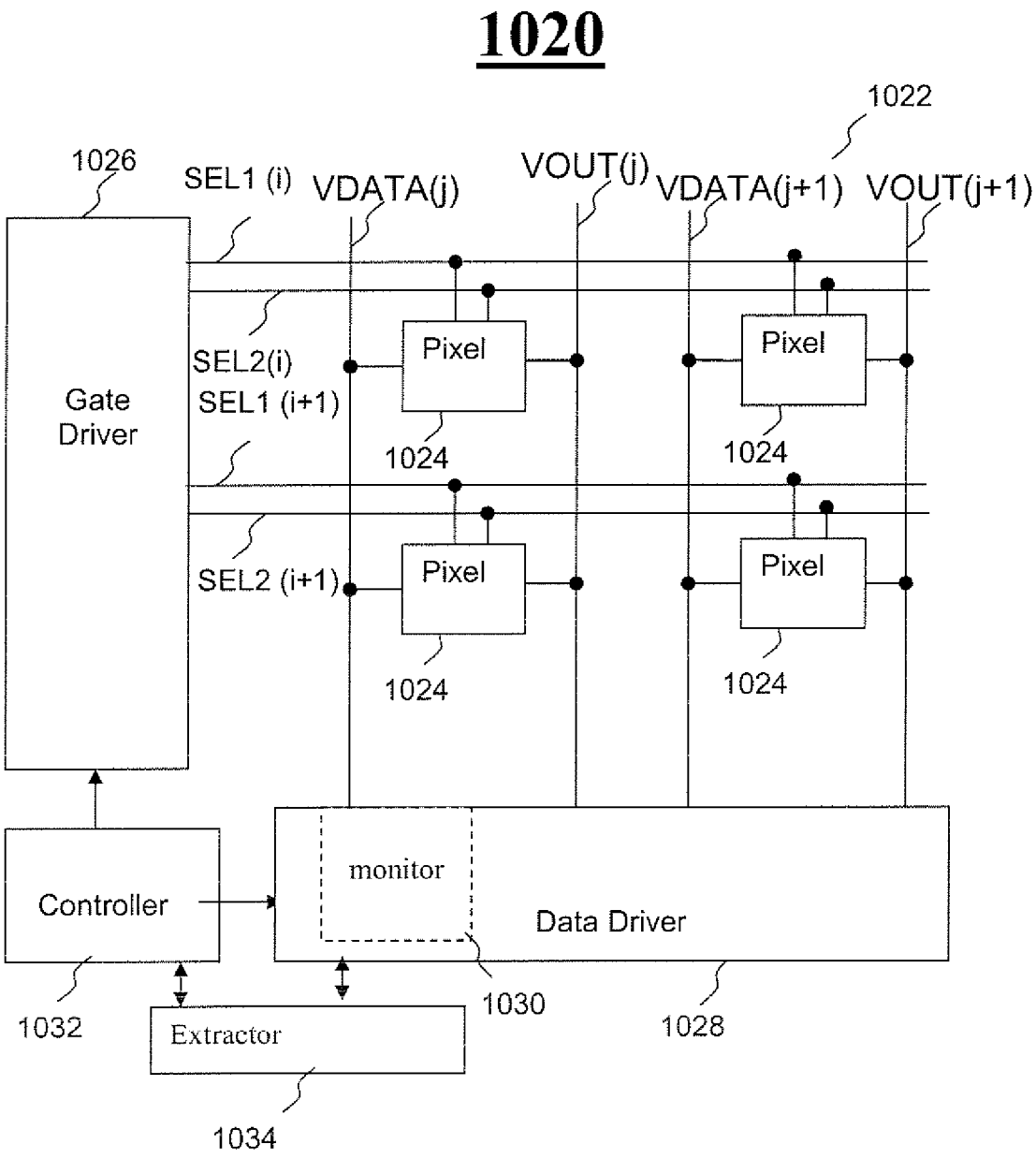
FIG. 10 illustrates an example of a display system having the pixel circuit of FIG. 7 or 8.

FIG. 10 illustrates an example of a display system having the pixel circuit of FIG. 7 or 8. The display system 1020 of FIG. 10 includes a pixel array 1022 having a plurality of pixels 1004 arranged in row and column. In FIG. 10, four pixels 1024 are shown. However, the number of the pixels 1024 may vary in dependence upon the system design, and does not limited to four. The pixel 1024 may be the pixel circuit 70 of FIG. 7 or the pixel circuit 90 of FIG. 8. The pixel array 1022 is an active matrix light emitting display, and may be an AMOLED display.

SEL1(k) (k=i, i+1) is a first select line for selecting the kth row, and corresponds to SEL1 of FIGS. 7 and 8. SEL2(k) (k=i, i+1) is a second select line for selecting the kth row, and corresponds to SEL2 of FIGS. 7 and 8. VOUT(1) (l=j, j+1) is an output line for the lth column, and corresponds to VOUT of FIGS. 7 and 8. VDATA(1) is a data line for the lth column, and corresponds to VDATA of FIGS. 7 and 8.

A gate driver 1026 drives SEL1(k) and SEL2(k). The gate driver 1026 includes an address driver for providing address signals to SEL1(k) and SEL2(k). A data driver 1028 generates a programming data and drives VDATA(1). The data driver 1028 includes a monitor 1030 for driving and monitoring the voltage of VOUT(1). Extractor block 1034 calculates the aging of the pixel based on the voltage generated on VOUT(i). VDATA(1) and VOUT (1) are appropriately activated for the operations of FIGS. 9A and 9B. VDATA(1) is calibrated using the monitoring result (i.e., the change of VOUT(1)). The monitoring result may be provided to a controller 1032. The data driver 1028, the controller 1032, the extractor 1034, or a combination thereof may include a memory for storing the monitoring result. The controller 1032 controls the drivers 1026 and 1028 and the extractor 1034 to drive the pixels 1004 as described above.

Figure 11A:
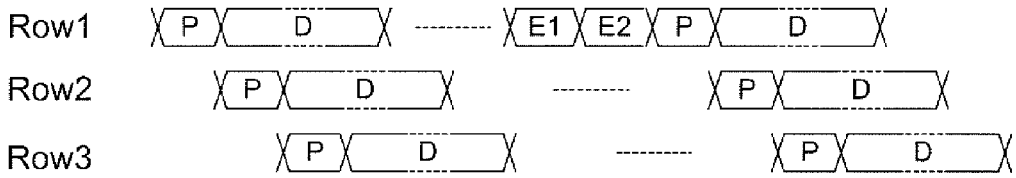
FIG. 11A illustrates an example of normal and extraction cycles for driving the pixel array of FIG. 10.
Figure 11B:
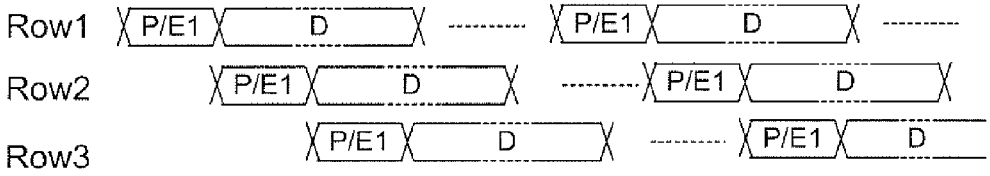
FIG. 11B illustrates another example of normal and extraction cycles for driving the pixel array of FIG. 10.

FIGS. 11A and 11B illustrate two examples of normal and extraction cycles for driving the pixel array of FIG. 10. In FIGS. 11A and 11B, each of ROWi (i=1, 2, . . . ) represents the ith row; "P" represents a programming cycle and corresponds to 120 of FIG. 9B; "D" represents a driving cycle and corresponds to 122 of FIG. 9B; "E1 " represents a first extraction cycle and corresponds to 110 of FIG. 9A; and "E2 " represents a second extraction cycle and corresponds to 112 of FIG. 9A. In FIG. 11A, the extraction can happen at the end of each frame during the blanking time. During this time, the aging of several pixels can be extracted. Also, an extra frame can be inserted between several frames in which all pixels are OFF. During this frame, one can extract the aging of several pixels without affecting the image quality. FIG. 11B shows a case in which one can do the extraction in parallel with programming cycle.

Figure 12:
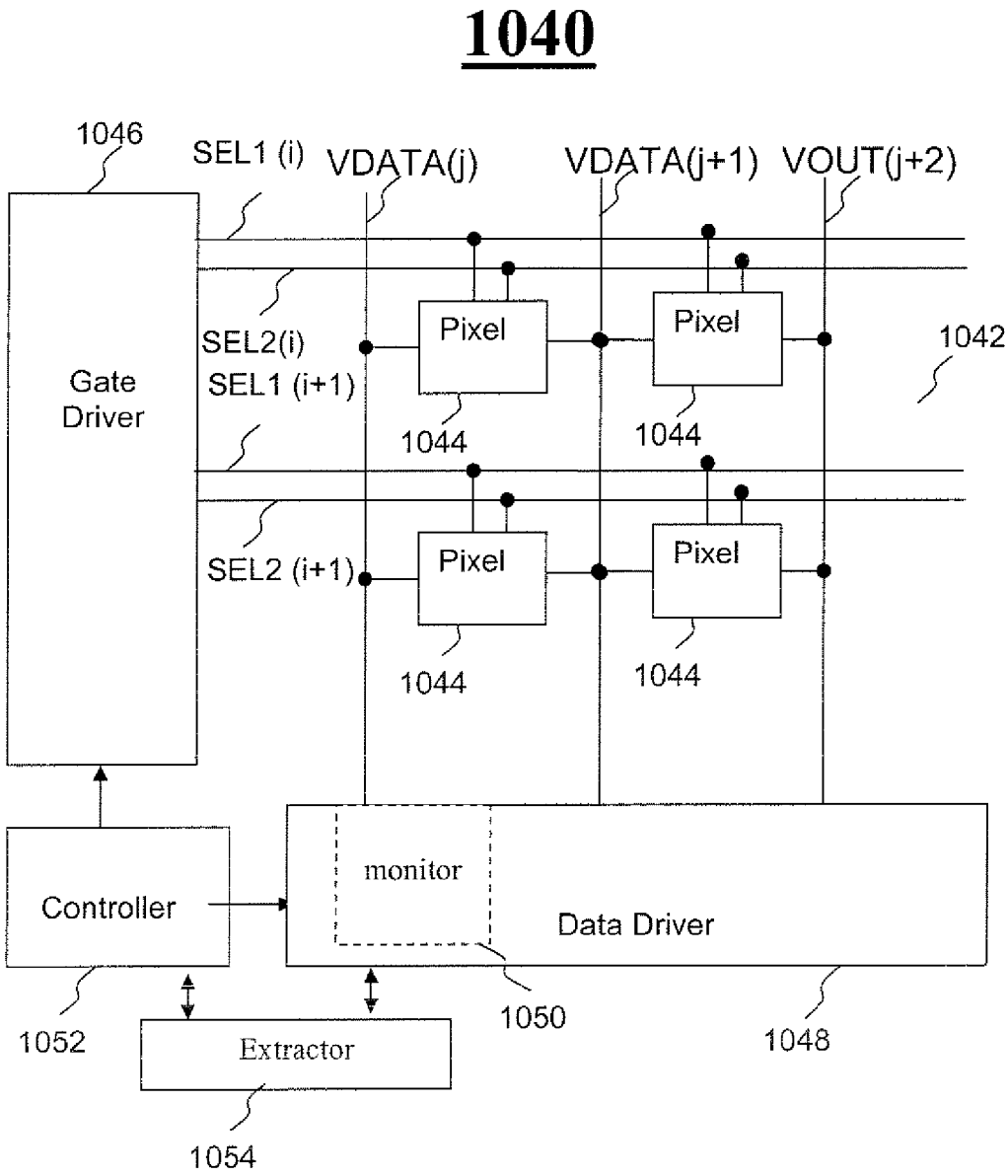
FIG. 12 illustrates another example of a display system having the pixel circuit of FIG. 7 or 8.

FIG. 12 illustrates another example of a display system having the pixel circuit of FIG. 7 or 8. The display system 1040 of FIG. 12 includes a pixel array 1042 having a plurality of pixels 1044 arranged in row and column. The display system 1040 is similar to the display system 1020 of FIG. 10. In FIG. 12, data line VDATA (j+1) is used as an output line VOUT(j) for monitoring the ageing of pixel.

A gate driver 1046 is the same or similar to the gate driver 1026 of FIG. 10. The gate driver 1046 includes an address driver for providing address signals to SEL1(k and SEL2(k). A data driver 1048 generates a programming data and drives VDATA(1). The data driver 1048 includes a monitor 1050 for monitoring the voltage of VDATA(1). VDATA(1) is appropriately activated for the operations of FIGS. 9A and 9B. Extractor block 1054 calculates the aging of the pixel based on the voltage generated on VDATA. VDATA(1) is calibrated using the monitoring result (i.e., the change of VDATA(1)). The monitoring result may be provided to a controller 1052. The data driver 1048, the controller 1052, the extractor 1054, or a combination thereof may include a memory for storing the monitoring result. The controller 1052 controls the drivers 1046 and 1048 and the extractor 1054 to drive the pixels 1004 as described above.

Figure 13:
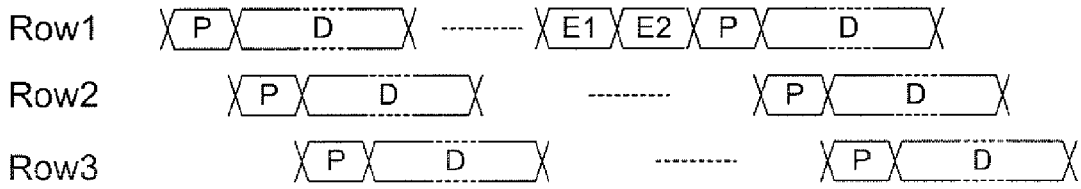
FIG. 13 illustrates an example of normal and extraction cycles for driving the pixel array of FIG. 12.

FIG. 13 illustrates an example of normal and extraction cycles for driving the pixel array 1042 of FIG. 12. In FIG. 13, each of ROWi (i=1, 2, . . . ) represents the ith row; "P" represents a programming cycle and corresponds to 120 of FIG. 9B; "D" represents a driving cycle and corresponds to 122 of FIG. 9B; "E1 " represents a first extraction cycle and corresponds to 110 of FIG. 9A; and "E2 " represents a second extraction cycle and corresponds to 112 of FIG. 9A. The extraction can happen at the end of each frame during the blanking time. During this time, the aging of several pixels can be extracted. Also, an extra frame can be inserted between several frames in which all pixels are OFF. During this frame, one can extract the aging of several pixels without affecting the image quality.

Figure 14:
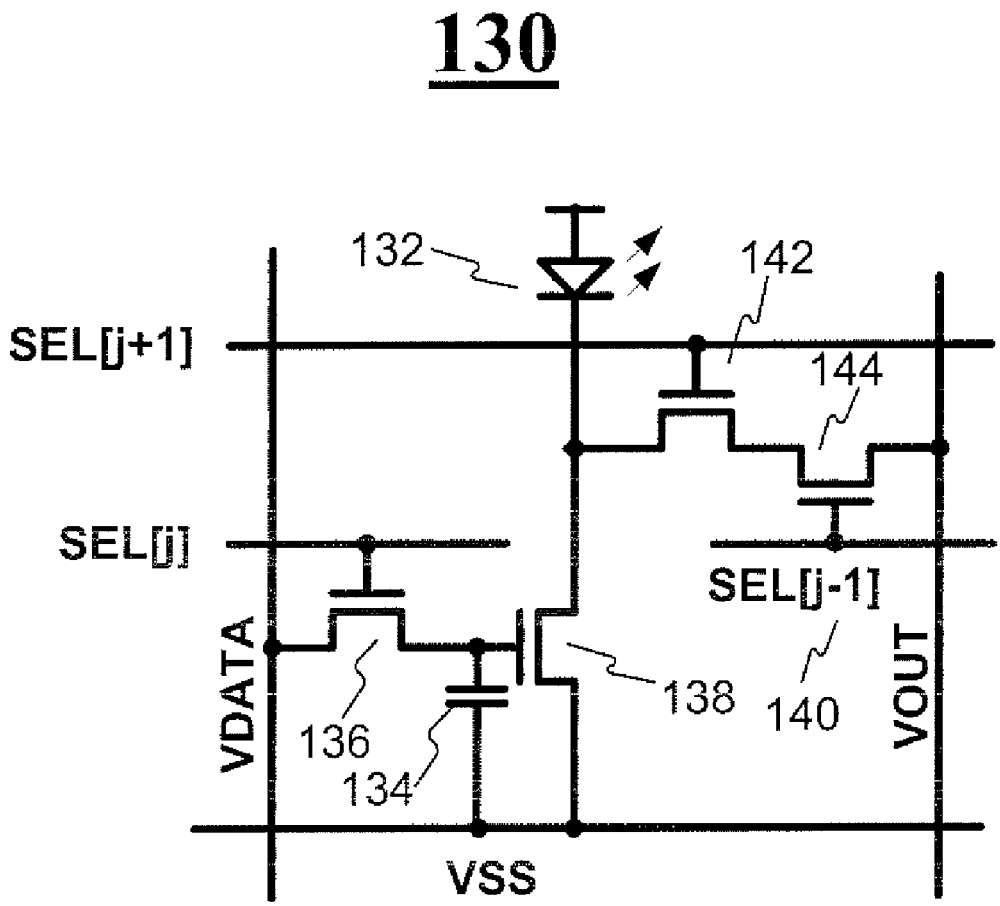
FIG. 14 illustrates an example of a 4-transistor (4T) pixel circuit to which a pixel operation technique in accordance with a further embodiment of the present invention is suitably applied.

FIG. 14 illustrates an example of a 4-transistor (4T) pixel circuit to which a pixel operation technique in accordance with a further embodiment of the present invention is suitably applied. The pixel circuit 130 of FIG. 14 includes an OLED 132, a storage capacitor 134, a switch transistor 136, and a drive transistor 138. The pixel circuit 130 forms an AMOLED display.

The drain terminal of the drive transistor 138 is connected to the OLED 132, and the source terminal of the drive transistor 138 is connected to a power supply line VSS (e.g., ground). One terminal of the switch transistor 136 is connected to a data line VDATA, and the other terminal of the switch transistor 136 is connected to the gate terminal of the drive transistor 138. The gate terminal of the switch transistor 136 is connected to a select line SEL[j]. One terminal of the storage capacitor 134 is connected to the gate terminal of the drive transistor 138, and the other terminal of the storage capacitor 134 is connected to VSS.

A sensing network 140 is provided to the pixel circuit 130. The network 140 may be included in the pixel circuit 130. The circuit 140 includes transistors 142 and 144. The transistors 142 and 144 are connected in series between the drain terminal of the drive transistor 138 and an output line VOUT. The gate terminal of the transistor 142 is connected to a select line SEL[j+1]. The gate terminal of the transistor 144 is connected to a select line SEL[j−1].

The select line SEL[k] (k=j−1, j, j+1) may be an address line for the kth row of a pixel array. The select line SEL[j−1] or SEL[j+1] may be replaced with SEL[j] where SEL[j] is ON when both of SEL[j−1] and SEL[j+1] signals are ON.

The aging of the pixel circuit 130 is extracted by monitoring the voltage of the output line VOUT. In one example, VOUT may be provided separately from VDATA. In another example, VOUT may be a data line VDATA for a physically adjacent column (row).

Figure 15:
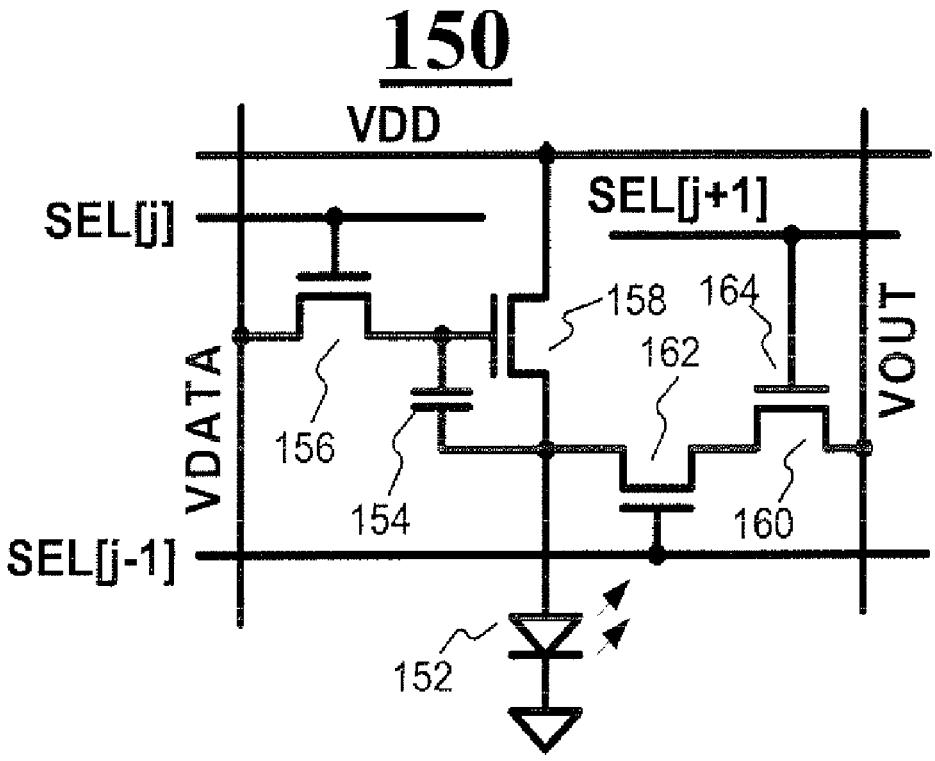
FIG. 15 illustrates another example of a 4T pixel circuit to which the pixel operation technique associated with FIG. 14 is suitably applied.

FIG. 15 illustrates another example of a 4T pixel circuit to which the pixel operation technique associated with FIG. 14 is suitably applied. The pixel circuit 150 of FIG. 15 includes an OLED 152, a storage capacitor 154, a switch transistor 156, and a drive transistor 158. The pixel circuit 150 forms an AMOLED display. The OLED 152 corresponds to the OLED 132 of FIG. 14. The storage capacitor 154 corresponds to the storage capacitor 134 of FIG. 14. The transistors 156 and 158 correspond to the transistors 136 and 138 of FIG. 14.

The source terminal of the drive transistor 158 is connected to the OLED 152, and the drain terminal of the drive transistor 158 is connected to a power supply line VDD. The switch transistor 156 is connected between a data line VDATA and the gate terminal of the drive transistor 158. One terminal of the storage capacitor 154 is connected to the gate terminal of the drive transistor 158, and the other terminal of the storage capacitor 154 is connected to the OLED 152 and the source terminal of the drive transistor 158.

A sensing network 160 is provided to the pixel circuit 150. The network 160 may be included in the pixel circuit 150. The circuit 160 includes transistors 162 and 164. The transistors 162 and 164 are connected in series between the source terminal of the drive transistor 158 and an output line VOUT. The gate terminal of the transistor 162 is connected to a select line SEL[j−1]. The gate terminal of the transistor 164 is connected to a select line SEL[j+1]. The transistors 162 and 164 correspond to the transistors 142 and 144 of FIG. 14.

The aging of the pixel circuit 150 is extracted by monitoring the voltage of the output line VOUT. In one example, VOUT may be provided separately from VDATA. In another example, VOUT may be a data line VDATA for a physically adjacent column (row).

Figure 16A:
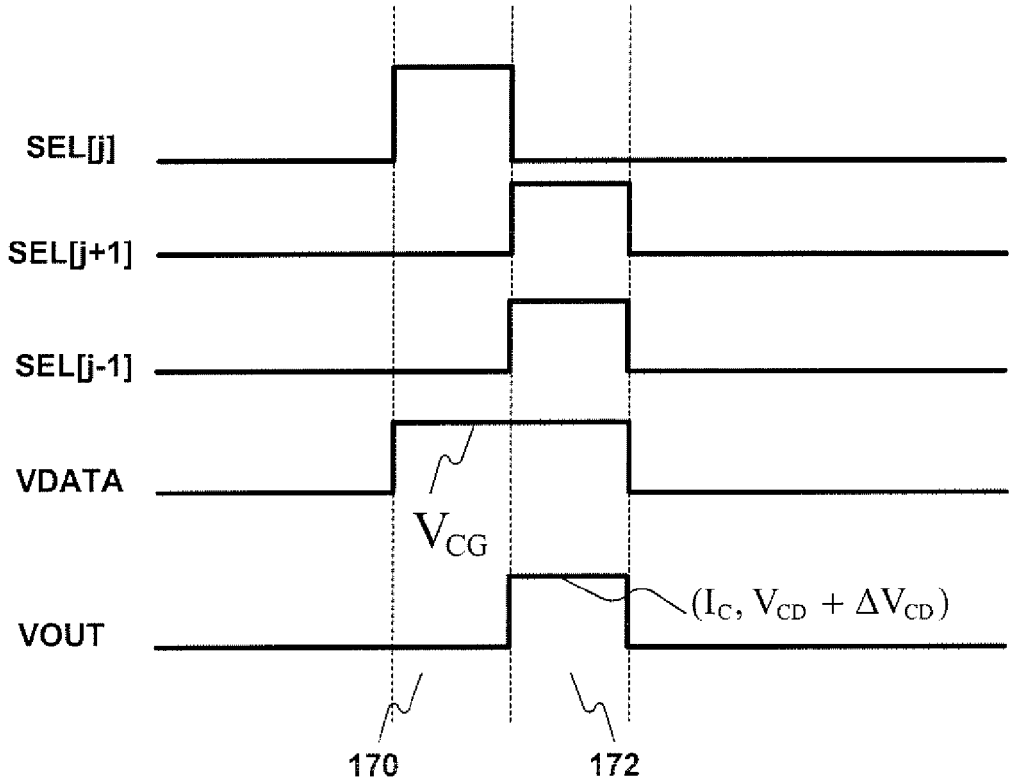
FIG. 16A illustrates an example of signal waveforms applied to the pixel circuits of FIGS. 14 and 15 during an extraction operation.
Figure 16B:
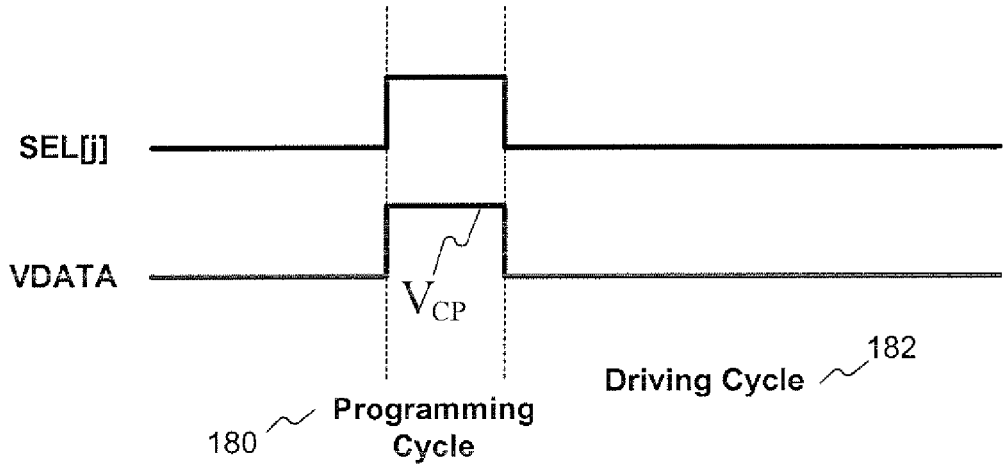
FIG. 16B illustrates an example of signal waveforms applied to the pixel circuits of FIGS. 14 and 15 during a normal operation.

FIG. 16A illustrates an example of signal waveforms applied to the pixel circuits of FIGS. 14 and 15 during an extraction operation. FIG. 16B illustrates an example of signal waveforms applied to the pixel circuits of FIGS. 14 and 15 during a normal operation.

Referring to 14, 15 and FIGS. 16A, the extraction operation for the pixel at position (i, j) includes first and second extraction cycles 170 and 172. During the first extraction cycle 170, the gate terminal of the drive transistor (138 of FIG. 14 or 158 of FIG. 15) is charged to a calibration voltage $V_{CG}$. This calibration voltage $V_{CG}$ includes the aging prediction, calculated based on the previous aging data. During the second extraction cycle 172, the select line SEL[i] goes to zero, and so the gate voltage of the drive transistor (138 of FIG. 14 or 158 of FIG. 15) is affected by the dynamic effects including the charge injection and clock feed-through. During the second extraction cycle 172, the drive transistor (138 of FIG. 14 or 158 of FIG. 15) acts as an amplifier since it is biased with a constant current through VOUT. The voltage developed on VOUT as a result of current Ic applied to it is ($V_{CD}+\Delta V_{CD}$). Therefore, the aging of the pixel is amplified, and change the voltage of the VOUT. Therefore, this method enables extraction of very small amount of voltage threshold (VT) shift resulting in highly accurate calibration. The change in VOUT is monitored, Then, the change(s) in VOUT is used for calibration of programming data.

Also, applying a current/voltage to the OLED during the extraction cycle, the system can extract the voltage/current of the OLED and determines the aging factor of the OLED and use it for more accurate calibration of the luminance data.

Referring to 14, 15 and 16B, the normal operation for the pixel at position (i, j) includes a programming cycle 180 and a driving cycle 182. During the programming cycle 180, the gate terminal of the drive transistor (138 of FIG. 14 or 158 of FIG. 15) is charged to a calibrated programming voltage $V_{CP}$ using the monitoring result (e.g., the changes of VOUT). During the driving cycle 182, the select line SEL[i] is low and the drive transistor (138 of FIG. 14 or 158 of FIG. 15) provides current to the OLED (142 of FIG. 14 or 152 of FIG. 15).

Figure 17:
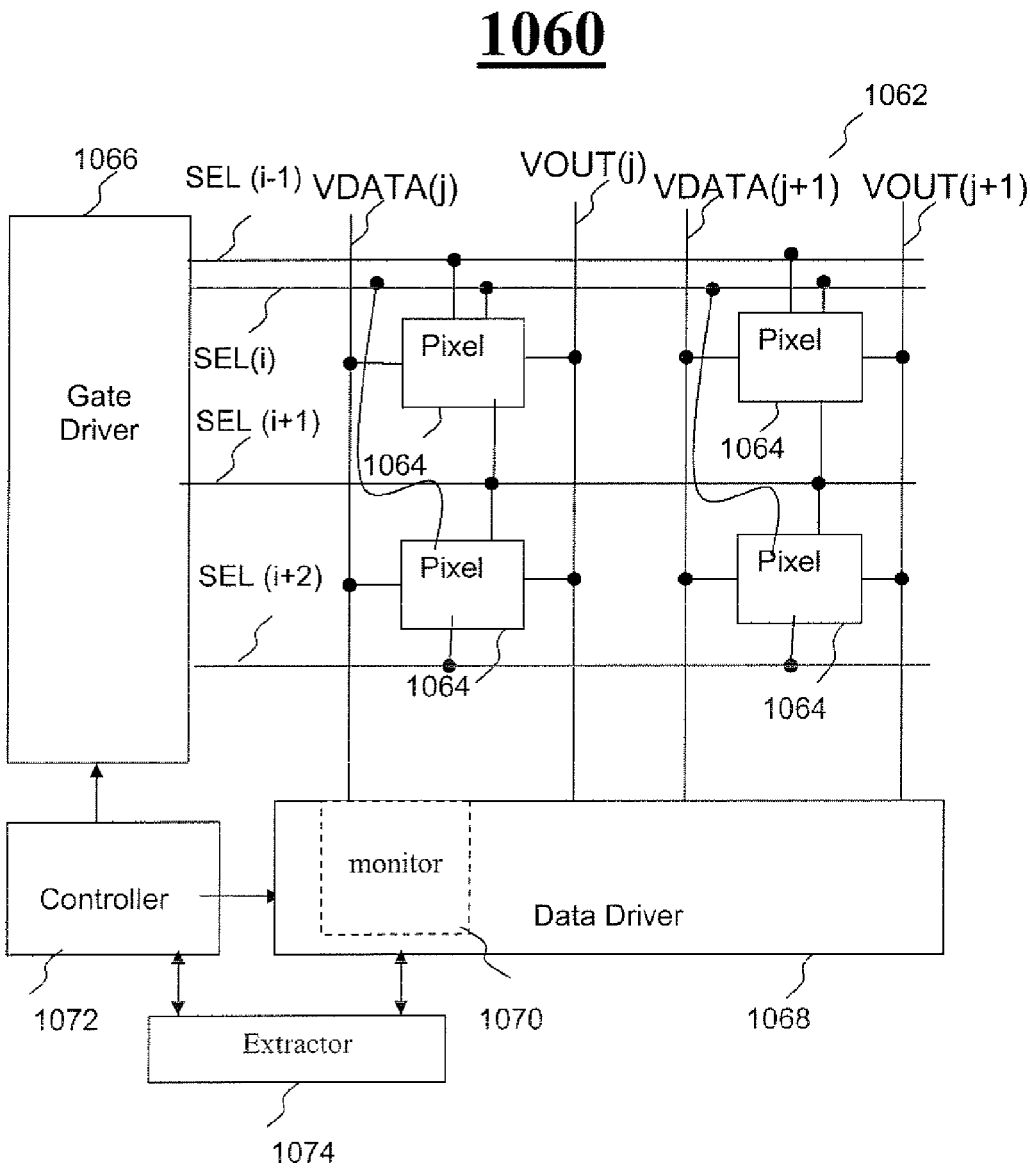
FIG. 17 illustrates an example of a display system having the pixel circuit of FIG. 14 or 15.

FIG. 17 illustrates an example of a display system having the pixel circuit of FIG. 14 or 15 where VOUT is separated from VDATA. The display system 1060 of FIG. 17 is similar to the display system 1020 of FIG. 10. The display system 1060 includes a pixel array having a plurality of pixels 1064 arranged in row and column. In FIG. 17, four pixels 1064 are shown. However, the number of the pixels 1064 may vary in dependence upon the system design, and does not limited to four. The pixel. 1064 may be the pixel circuit 130 of FIG. 1.4 or the pixel circuit 150 of FIG. 15. The pixel array of FIG. 13 is an active matrix light emitting display, and may be an AMOLED display.

SEL1(k) (k=i−1, i, i+1, i+2) is a select line for selecting the kth row, and corresponds to SEL[j−1], SEL[j] and SEL[j+1] of FIGS. 14 and 15. VOUT(1) (l=j, j+1) is an output line for the lth column, and corresponds to VOUT of FIGS. 14 and 15. VDATA(1) is a data line for the lth column, and corresponds to VDATA of FIGS. 14 and 15.

A gate driver 1066 drives SEL(k). The gate driver 1066 includes an address driver for providing address signals to SEL(k). A data driver 1068 generates a programming data and drives VDATA(1). The data driver 1068 includes a monitor 1070 for driving and monitoring the voltage of VOUT(1). Extract-r block 1074 calculates the aging of the pixel based on the voltage generated on VOUT(1). VDATA(1) and VOUT (1) are appropriately activated for the operations of FIGS. 16A and 16B. VDATA(1) is calibrated using the monitoring result (i.e., the change of VOUT(1)). The monitoring result may be provided to a controller 1072. The data driver 1068, the controller 1072, the extractor 1074, or a combination thereof may include a memory for storing the monitoring result. The controller 1072 controls the drivers 1066 and 1068 and the extractor 1074 to drive the pixels 1064 as described above.

Figure 18:
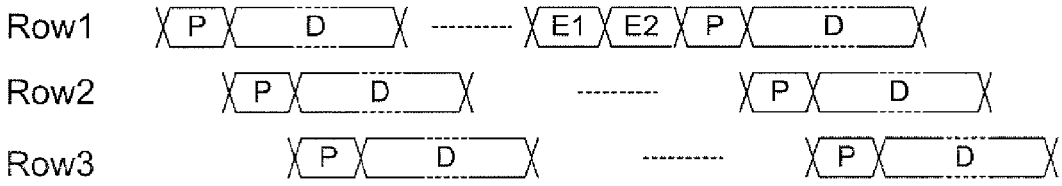
FIG. 18 illustrates an example of normal and extraction cycles for driving the pixel array of FIG. 17.

FIG. 18 illustrates an example of the normal and extraction cycles for driving the pixel array of FIG. 17. In FIG. 18, each of ROWi (i=1, 2, . . . ) represents the ith row; "P" represents a programming cycle and corresponds to 180 of FIG. 16B; "D" represents a driving cycle and corresponds to 182 of FIG. 16B; "E1 " represents the first and second extraction cycle and corresponds to 170 of FIG. 16A; and "E2 " represents a second extraction cycle and corresponds to 172 of FIG. 16A. The extraction can happen at the end of each frame during the blanking time. During this time, the aging of several pixels can be extracted. Also, an extra frame can be inserted between several frames in which all pixels are OFF. During this frame, one can extract the aging of several pixels without affecting the image quality.

Figure 19:
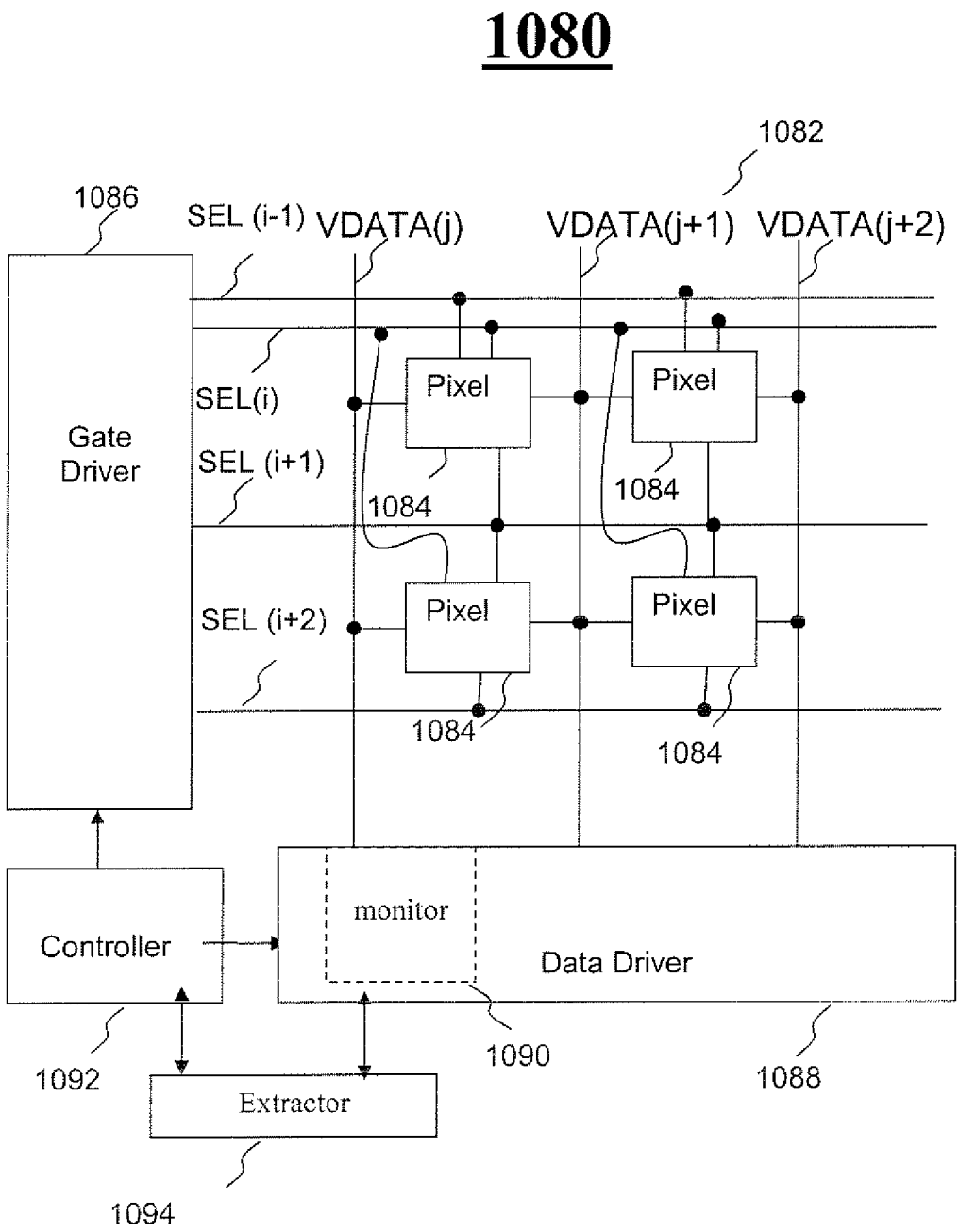
FIG. 19 illustrates another example of a display system having the pixel circuit of FIG. 14 or 15.

FIG. 19 illustrates another example of a display system having the pixel circuit of FIG. 14 or 15 where VDATA is used as VOUT. The display system 1080 of FIG. 19 is similar to the display system 1040 of FIG. 12. The display system 1080 includes a pixel array having a plurality of pixels 1084 arranged in row and column. In FIG. 19, four pixels 1084 are shown. However, the number of the pixels 1084 may vary in dependence upon the system design, and does not limited to four. The pixel 1084 may be the pixel circuit 130 of FIG. 14 or the pixel circuit 150 of FIG. 15. The pixel array of FIG. 19 is an active matrix light emitting display, and may be an AMOLED display.

In the display system of FIG. 19, VDATA is used as a data line for the lth column and an output line for monitoring the pixel aging.

A gate driver 1066 drives SEL(k). The gate driver 1086 includes an address driver for providing address signals to SEL(k). A data driver 1088 generates a programming data and drives VDATA(1). The data driver 1088 includes a monitor 1090 for driving and monitoring the voltage of VDATA(1). Extractor block 1094 calculates the aging of the pixel based on the voltage generated on VDATA(1). VDATA(1) is appropriately activated for the operations of FIGS. 16A and 16B. VDATA(1) is calibrated using the monitoring result (i.e., the change of VDATA(1)). The monitoring result maybe provided to a controller 1092. The data driver 1088, the controller 1092, the extractor 1094, or a combination thereof may include a memory for storing the monitoring result. The controller 1092 controls the drivers 1086 and 1088 and the extractor 1094 to drive the pixels 1084 as described above.

Figure 20:
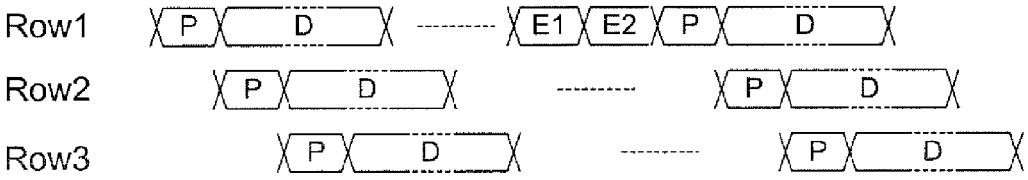
FIG. 20 illustrates an example of normal and extraction cycles for driving the pixel array of FIG. 19.

FIG. 20 illustrates an example of the normal and extraction cycles for driving the pixel array of FIG. 19. In FIG. 20, each of ROWi (i=1, 2, . . . ) represents the ith row; "P" represents a programming cycle and corresponds to 180 of FIG. 16B; "D" represents a driving cycle and corresponds to 182 of FIG. 16B; "E1 " represents the first extraction cycle and corresponds to 170 of FIG. 16A; and "E2 " represents a second extraction cycle and corresponds to 172 of FIG. 16A. The extraction can happen at the end of each frame during the blanking time. During this time, the aging of several pixels can be extracted. Also, an extra frame can be inserted between several frames in which all pixels are OFF. During this frame, one can extract the aging of several pixels without affecting the image quality.

Figure 21:
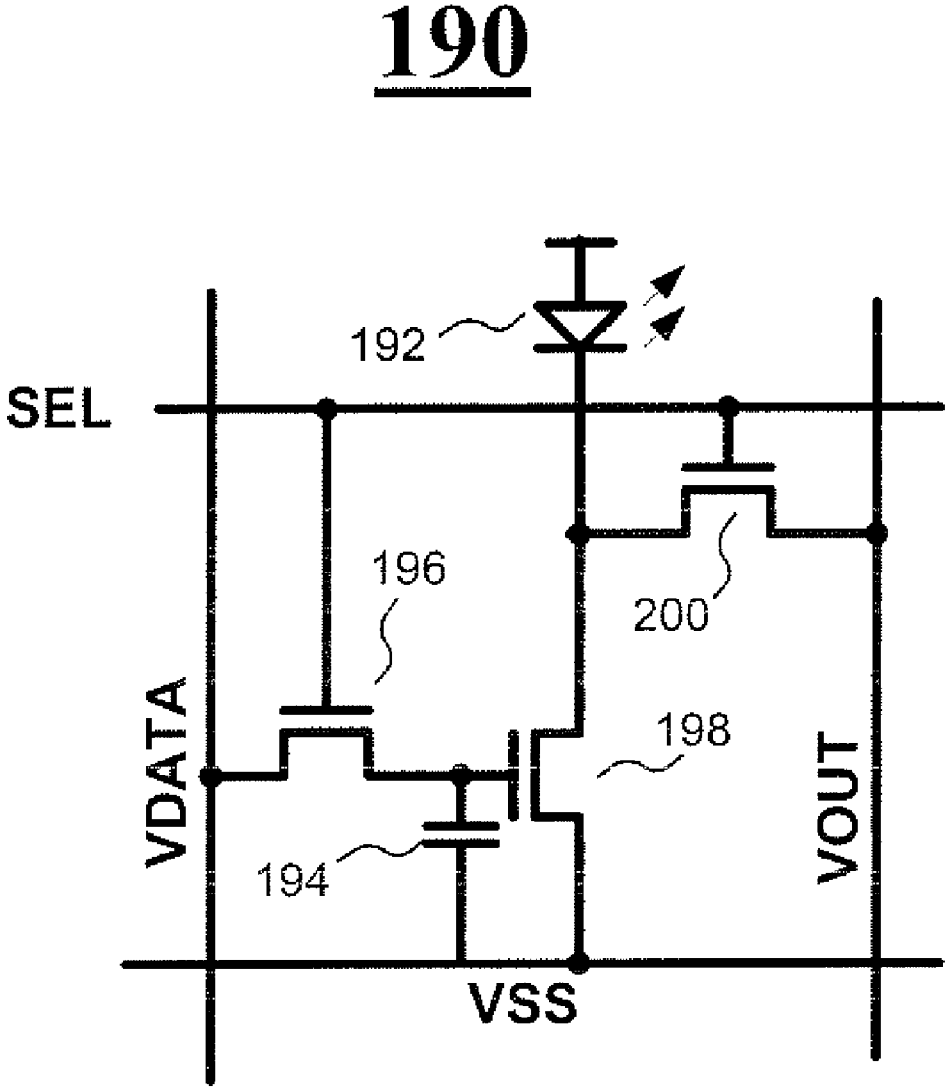
FIG. 21 illustrates an example of a 3T pixel circuit to which a pixel operation technique in accordance with a further embodiment of the present invention is suitably applied.

FIG. 21 illustrates an example of a 3T pixel circuit to which a pixel operation scheme in accordance with a further embodiment of the present invention is suitably applied. The pixel circuit 190 of FIG. 21 includes an OLED 172, a storage capacitor 194, a switch transistor 196, and a drive transistor 198. The pixel circuit 190 forms an AMOLED display.

The drain terminal of the drive transistor 198 is connected to the OLED 192, and the source terminal of the drive transistor 198 is connected to a power supply line VSS (e.g. ground). One terminal of the switch transistor 196 is connected to a data line VDATA, and the other terminal of the switch transistor 196 is connected to the gate terminal of the drive transistor 198. The gate terminal of the switch transistor 196 is connected to a select line SEL. One terminal of the storage capacitor 194 is connected to the gate terminal of the drive transistor 198, and the other terminal of the storage capacitor 194 is connected to VSS.

A sensing transistor 200 is provided to the pixel circuit 190. The transistor 200 may be included in the pixel circuit 190. The transistor 200 is connected between the drain terminal of the drive transistor 198 and an output line VOUT. The gate terminal of the transistor 200 is connected to the select line SEL.

The aging of the pixel circuit 190 is extracted by monitoring the voltage of the output line VOUT. SEL is shared by the switch transistor 196 and the transistor 200.

Figure 22:
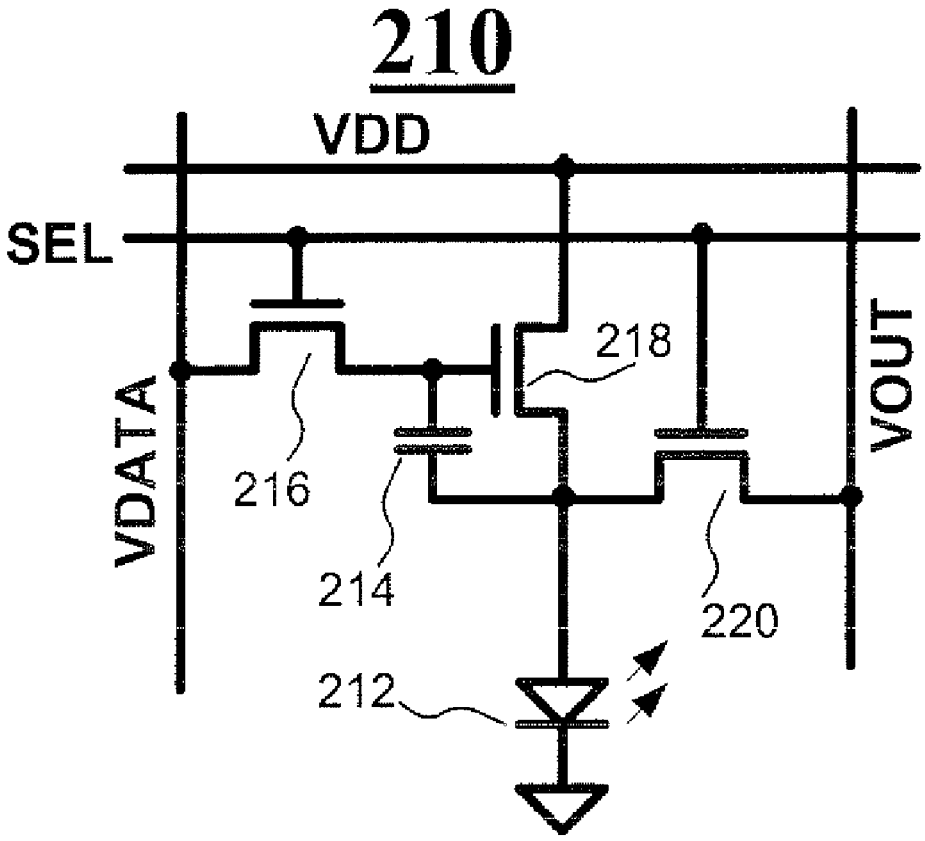
FIG. 22 illustrates another example of a 3T pixel circuit to which the pixel operation technique associated with FIG. 21 is suitably applied.

FIG. 22 illustrates another example of a 3-transistor (3T) pixel circuit to which the pixel operation technique associated with FIG. 21 is suitably applied. The pixel circuit 210 of FIG. 22 includes an OLED 212, a storage capacitor 214, a switch transistor 216, and a drive transistor 218. The OLED 212 corresponds to the OLED 192 of FIG. 21. The storage capacitor 214 corresponds to the storage capacitor 194 of FIG. 21. The transistors 216 and 218 correspond to the transistors 196 and 198 of FIG. 21. The pixel circuit 210 forms an AMOLED display.

The drain terminal of the drive transistor 218 is connected to a power supply line VDD, and the source terminal of the drive transistor 218 is connected to the OLED 212. The switch transistor 216 is connected between a data line VDATA and the gate terminal of the drive transistor 218. One terminal of the storage capacitor 214 is connected to the gate terminal of the drive transistor 218, and the other terminal of the storage capacitor 214 is connected to the source terminal of the drive transistor 218 and the OLED 212.

A sensing transistor 220 is provided to the pixel circuit 210. The transistor 220 may be included in the pixel circuit 210. The transistor 220 connects the source terminal of the drive transistor 218 and the OLED 212 to an output line VOUT. The transistor 220 corresponds to the transistor 200 of FIG. 21. The gate terminal of the transistor 220 is connected to the select line SEL.

The aging of the pixel circuit 210 is extracted by monitoring the voltage of the output line VOUT. SEL is shared by the switch transistor 216 and the transistor 220.

Figure 23A:
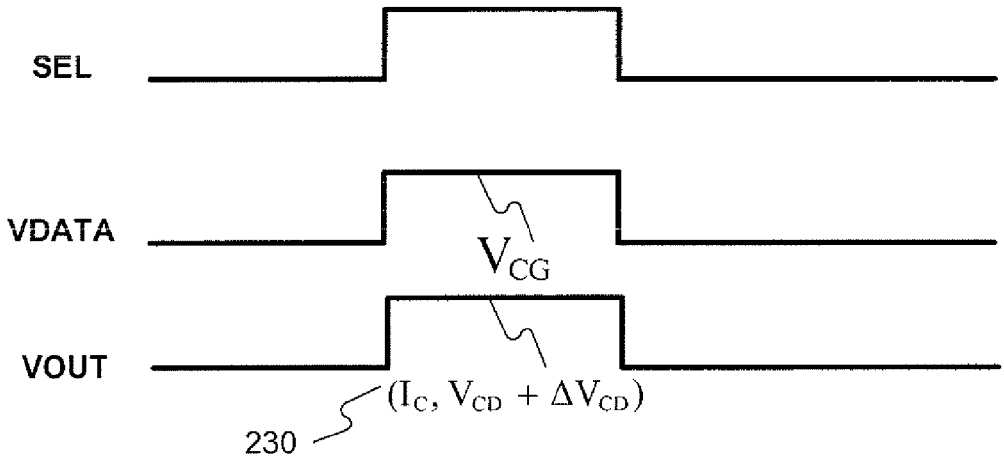
FIG. 23A illustrates an example of signal waveforms applied to the pixel circuits of FIGS. 21 and 22 during an extraction operation.
Figure 23B:
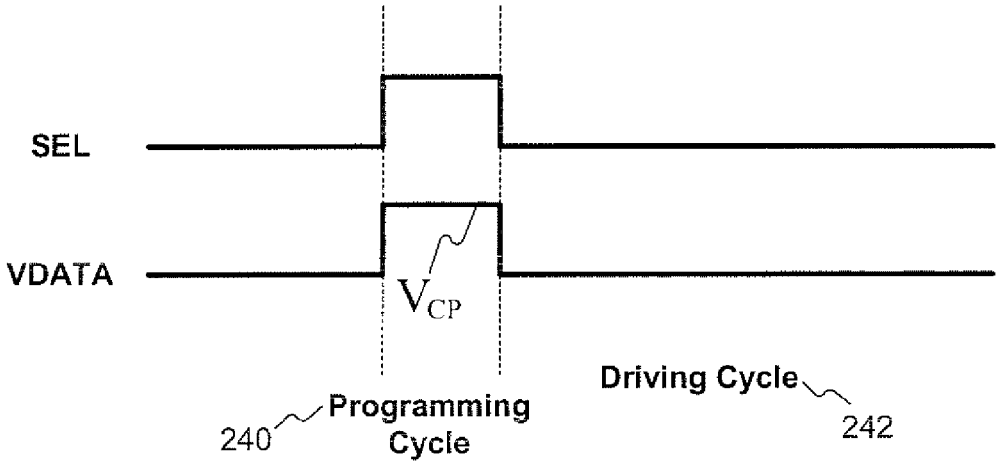
FIG. 23B illustrates an example of signal waveforms applied to the pixel circuits of FIGS. 21 and 22 during a normal operation.

FIG. 23A illustrates an example of signal waveforms applied to the pixel circuits of FIGS. 21 and 22 during an extraction operation. FIG. 23B illustrates an example of signal waveforms applied to the pixel circuits of FIGS. 21 and 22 during a normal operation.

Referring to 21, 22 and FIG. 23A, the extraction operation includes an extraction cycle 170. During the extraction cycle 170, the gate terminal of the drive transistor (198 of FIG. 21 or 218 of FIG. 22) is charged to a calibration voltage $V_{CG}$. This calibration voltage $V_{CG}$ includes the aging prediction, calculated based on the previous aging data. During the extraction cycle 230, the drive transistor (198 of FIG. 21 or 218 of FIG. 22) acts as an amplifier since it is biased with a constant current through VOUT. The voltage developed on VOUT as a result of current Ic applied to it is ($V_{CD}+\Delta V_{CD}$). Therefore, the aging of the pixel is amplified, and change the voltage of the VOUT. Therefore, this method enables extraction of very small amount of voltage threshold (VT) shift resulting in highly accurate calibration. The change in VOUT is monitored. Then, the change(s) in VOUT is used for calibration of programming data Also, applying a current/voltage to the OLED during extraction cycle, the system can extract the voltage/current of the OLED and determines the aging factor of the OLED and use it for more accurate calibration of the luminance data.

Referring to 21, 22 and 23B, the normal operation includes a programming cycle 240 and a driving cycle 242. During the programming cycle 240, the gate terminal of the drive transistor (198 of FIG. 21 or 218 of FIG. 22) is charged to a calibrated programming voltage $V_{CP}$ using the monitoring result (i.e., the changes of VOUT). During the driving cycle 242, the select line SEL is low and the drive transistor (198 of FIG. 21 or 218 of FIG. 22) provides current to the OLED (192 of FIG. 21 or 212 of FIG. 22).

Figure 24:
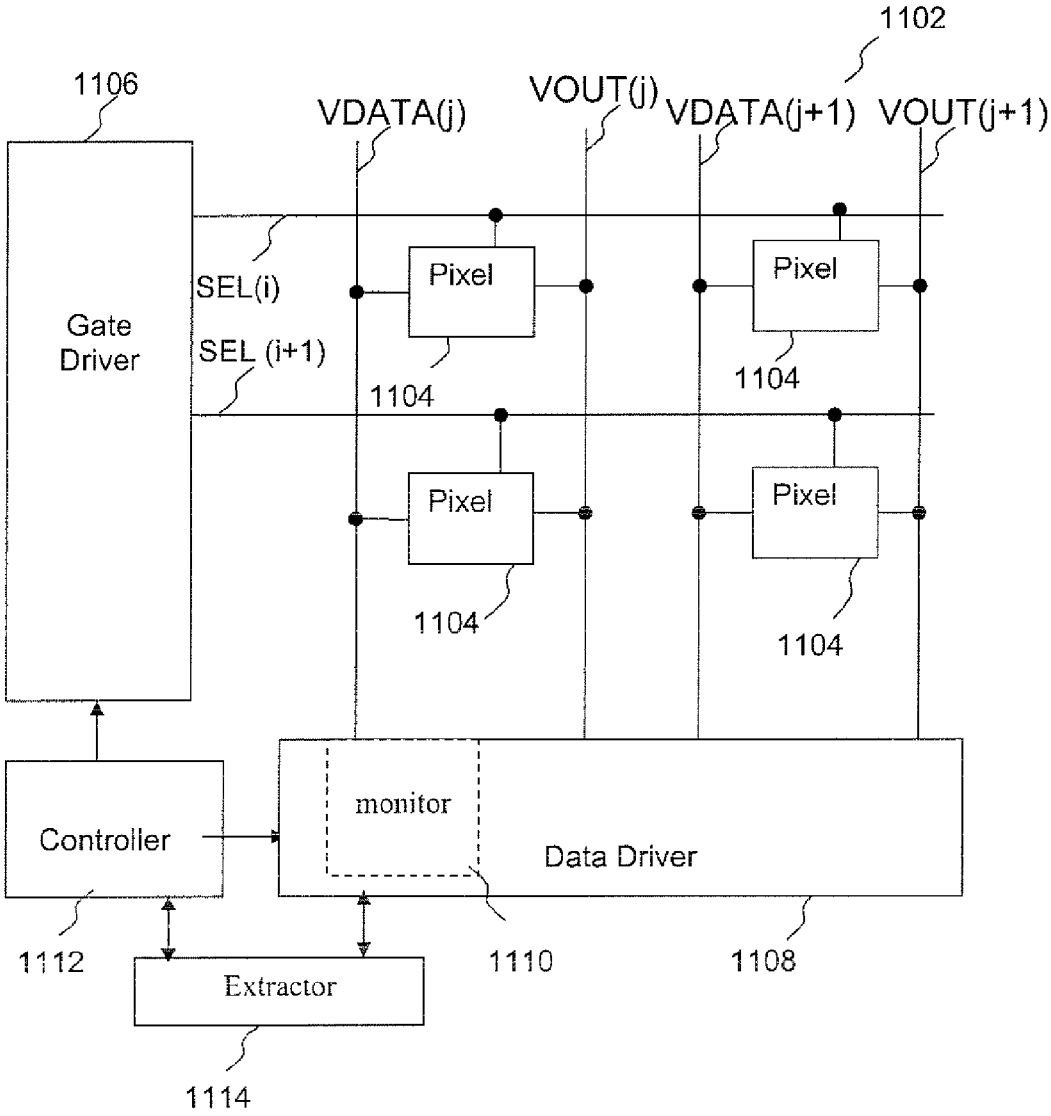
FIG. 24 illustrates an example of a display system having the pixel circuit of FIG. 21 or 22.

FIG. 24 illustrates an example of a display system having the pixel circuit of FIG. 21 or 22 where VOUT is separated from VDATA. The display system 1100 of FIG. 24 includes a pixel array having a plurality of pixels 1104 arranged in row and column, In FIG. 24, four pixels 1104 are shown. However, the number of the pixels 1104 may van, in dependence upon the system design, and does not limited to four. The pixel 1104 may be the pixel circuit 190 of FIG. 21 or the pixel circuit 210 of FIG. 22. The pixel array of FIG. 24 is an active matrix light emitting display, and may be an AMOLED display.

SEL(k) (k=i, i+1) is a select line for selecting the kth row, and corresponds to SEL of FIGS. 21 and 22. VOUT(1) (l=j, j+1) is an output line for the lth column, and corresponds to VOUT of FIGS. 21 and 22. VDATA(1) is a data line for the lth column, and corresponds to VDATA of FIGS. 21 and 22.

A gate driver 1106 drives SEL(k). The gate driver 1106 includes an address driver for providing address signals to SEL(k). A data driver 1108 generates a programming data and drives VDATA(1). The data driver 1108 includes a monitor 1110 for driving and monitoring the voltage of VOUT(1). Extractor block 1114 calculates the aging of the pixel based on the voltage generated on VOUT(1). VDATA(1) and VOUT (1) are appropriately activated for the operations of FIGS. 23A and 23B. VDATA(1) is calibrated using the monitoring result (i.e., the change of VOUT(1)). The monitoring result may be provided to a controller 1112. The data driver 1108, the controller 1112, the extractor 114, or a combination thereof may include a memory for storing the monitoring result. The controller 1112 controls the drivers 1106 and 1108 and the extractor 1114 to drive the pixels 1104 as described above.

Figure 25A:
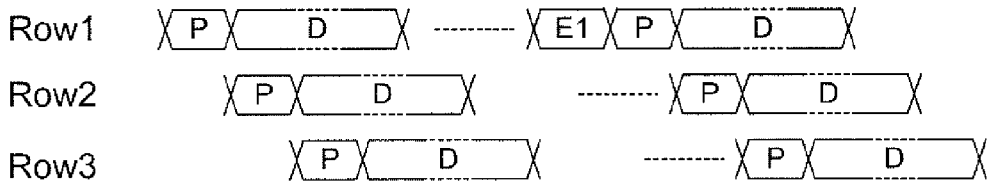
FIG. 25A illustrates an example of normal and extraction cycles for driving the pixel array of FIG. 24.
Figure 25B:
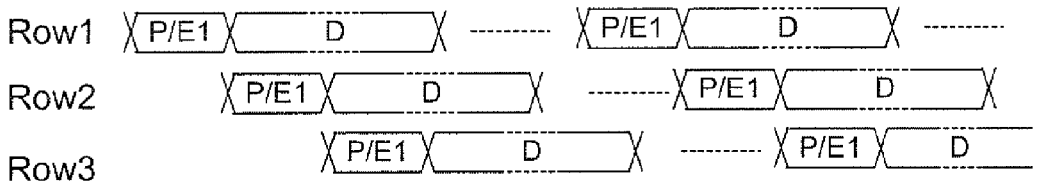
FIG. 25B illustrates another example of normal and extraction cycles for driving the pixel array of FIG. 24.

FIGS. 25A and 25B illustrate two examples of the normal and extraction cycles for driving the pixel array of FIG. 24. In FIGS. 25A and 25B, each of ROWi (i=1, 2, . . . ) represents the ith row; "P" represents a programming cycle and corresponds to 240 of FIG. 23B; "D" represents a driving cycle and corresponds to 242 of FIG. 23B; "E1 " represents the first extraction cycle and corresponds to 230 of FIG. 23A. In FIG. 25A, the extraction can happen at the end of each frame during the blanking time. During this time, the aging of several pixels can be extracted. Also, an extra frame can be inserted between several frames in which all pixels are OFF. During this frame, one can extract the aging of several pixels without affecting the image quality. In FIG. 25B, the extraction and programming happens in parallel.

Figure 26:
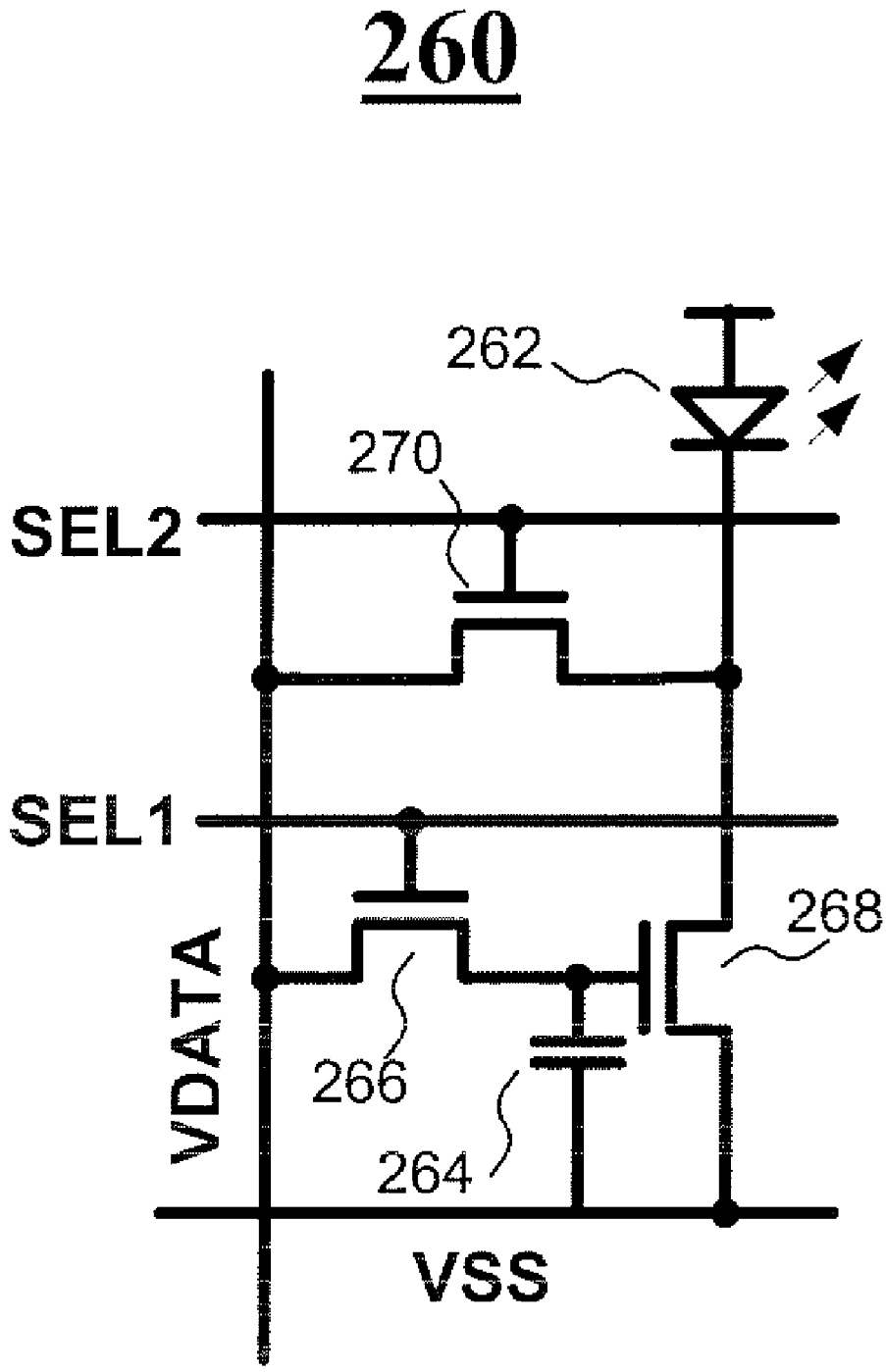
FIG. 26 illustrates an example of a 3T pixel circuit to which a pixel operation technique in accordance with a further embodiment of the present invention is suitably applied.

FIG. 26 illustrates an example of a 3T pixel circuit to which a pixel operation technique in accordance with a further embodiment of the present invention is suitably applied. The pixel circuit 260 of FIG. 26 includes an OLED 262, a storage capacitor 264, a switch transistor 266, and a drive transistor 268. The pixel circuit 260 forms an AMOLED display.

The OLED 262 corresponds to the OLED 192 of FIG. 21. The capacitor 264 corresponds to the capacitor 194 of FIG. 21. The transistors 264 and 268 correspond to the transistors 196 and 198 of FIG. 21, respectively. The gate terminal of the switch transistor 266 is connected to a first select line SEL1.

A sensing transistor 270 is provided to the pixel circuit 260. The transistor 270 may be included in the pixel circuit 260. The transistor 270 is connected between the drain terminal of the drive transistor 268 and VDATA. The gate terminal of the transistor 270 is connected to a second select line SEL2.

The aging of the pixel circuit 260 is extracted by monitoring the voltage of VDADA. VDATA is shared for programming and extracting the pixel aging.

Figure 27:
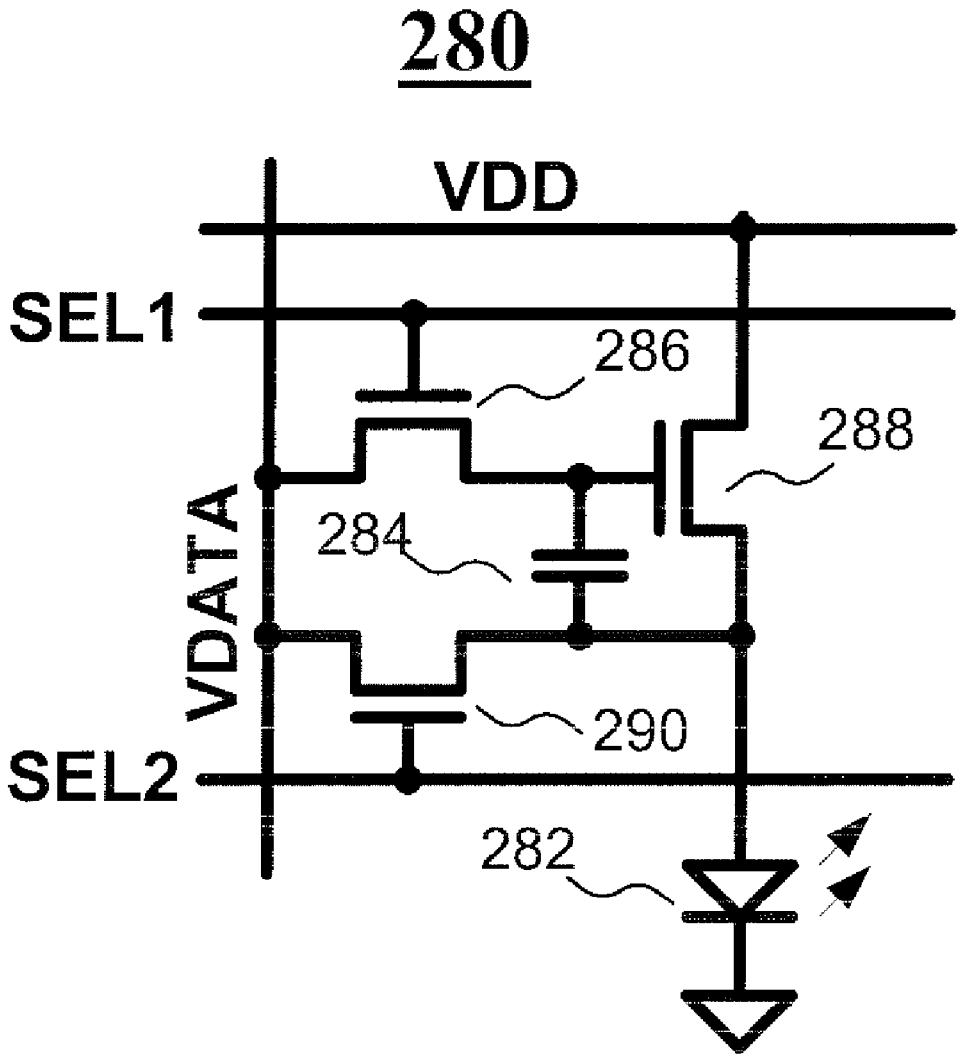
FIG. 27 illustrates another example of a 3T pixel circuit to which the pixel operation technique associated with FIG. 26 is suitably applied.

FIG. 27 illustrates another example of a 3T pixel circuit to which the pixel operation technique associated with FIG. 26 is suitably applied. The pixel circuit 280 of FIG. 27 includes an OLED 282, a storage capacitor 284, a switch transistor 286, and a drive transistor 288. The pixel circuit 280 forms an AMOLED display.

The OLED 282 corresponds to the OLED 212 of FIG. 22. The capacitor 284 corresponds to the capacitor 214 of FIG. 22. The transistors 284 and 288 correspond to the transistors 216 and 218 of FIG. 22, respectively. The gate terminal of the switch transistor 286 is connected to a first select line SEL1.

A sensing transistor 290 is provided to the pixel circuit 280. The transistor 290 may be included in the pixel circuit 280. The transistor 290 is connected between the source terminal of the drive transistor 288 and VDATA. The transistor 290 corresponds to the transistor 270 of FIG. 26. The gate terminal of the transistor 290 is connected to a second select line SEL2.

The aging of the pixel circuit 280 is extracted by monitoring the voltage of VDADA. VDATA is shared for programming and extracting the pixel aging.

Figure 28A:
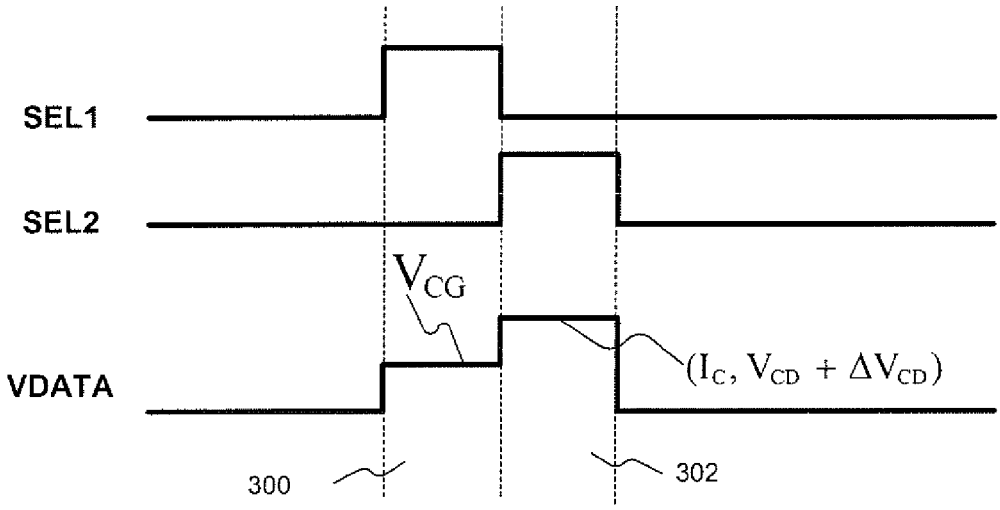
FIG. 28A illustrates an example of signal waveforms applied to the pixel circuits of FIGS. 26 and 27 during an extraction operation.
Figure 28B:
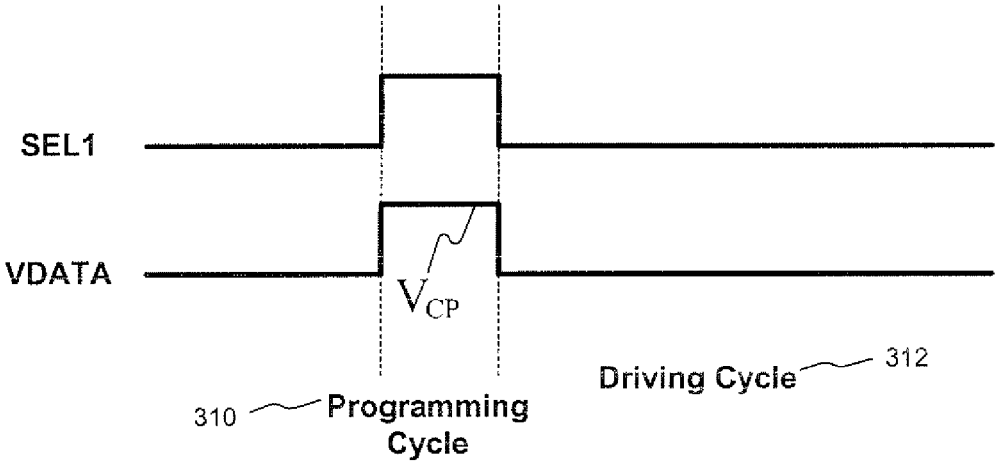
FIG. 28B illustrates an example of signal waveforms applied to the pixel circuits of FIGS. 26 and 27 during a normal operation.

FIG. 28A illustrates an example of signal waveforms applied to the pixel circuits of FIGS. 26 and 27 during an extraction operation. FIG. 28B illustrates an example of signal waveforms applied to the pixel circuits of FIGS. 26 and 27 during a normal operation.

Referring to 26, 27 and FIG. 28A, the extraction operation includes first and second extraction cycles 300 and 302. During the first extraction cycle 300, the gate terminal of the drive transistor (268 of FIG. 26 or 288 of FIG. 27) is charged to a calibration voltage $V_{CG}$. This calibration voltage $V_{CG}$ includes the aging prediction, calculated based on the previous aging data. During the second extraction cycle 302, the drive transistor (268 of FIG. 26 or 288 of FIG. 27) acts as an amplifier since it is biased with a constant current through VDATA. Therefore, the aging of the pixel is amplified, and the voltage of the VDATA changes accordingly. Therefore, this method enables extraction of very small amount of voltage threshold (VT) shift resulting in highly accurate calibration. The change in VDATA is monitored. Then, the change(s) in VDATA is used for calibration of programming data Also, applying a current/voltage to the OLED during extraction cycle, the system can extract the voltage/current of the OLED and determines the aging factor of the OLED and use it for more accurate calibration of the luminance data.

Referring to 26, 27 and 28B, the normal operation includes a programming cycle 310 and a driving cycle 312. During the programming cycle 310, the gate terminal of the drive transistor (268 of FIG. 26 or 288 of FIG. 27) is charged to a calibrated programming voltage $V_{CP}$ using the monitoring result (i.e., the changes of VDATA). Next, during the driving cycle 312, the select line SEL1 is low and the drive transistor (268 of FIG. 26 or 288 of FIG. 27) provides current to the OLED (262 of FIG. 26, or 282 of FIG. 27).

Figure 29:
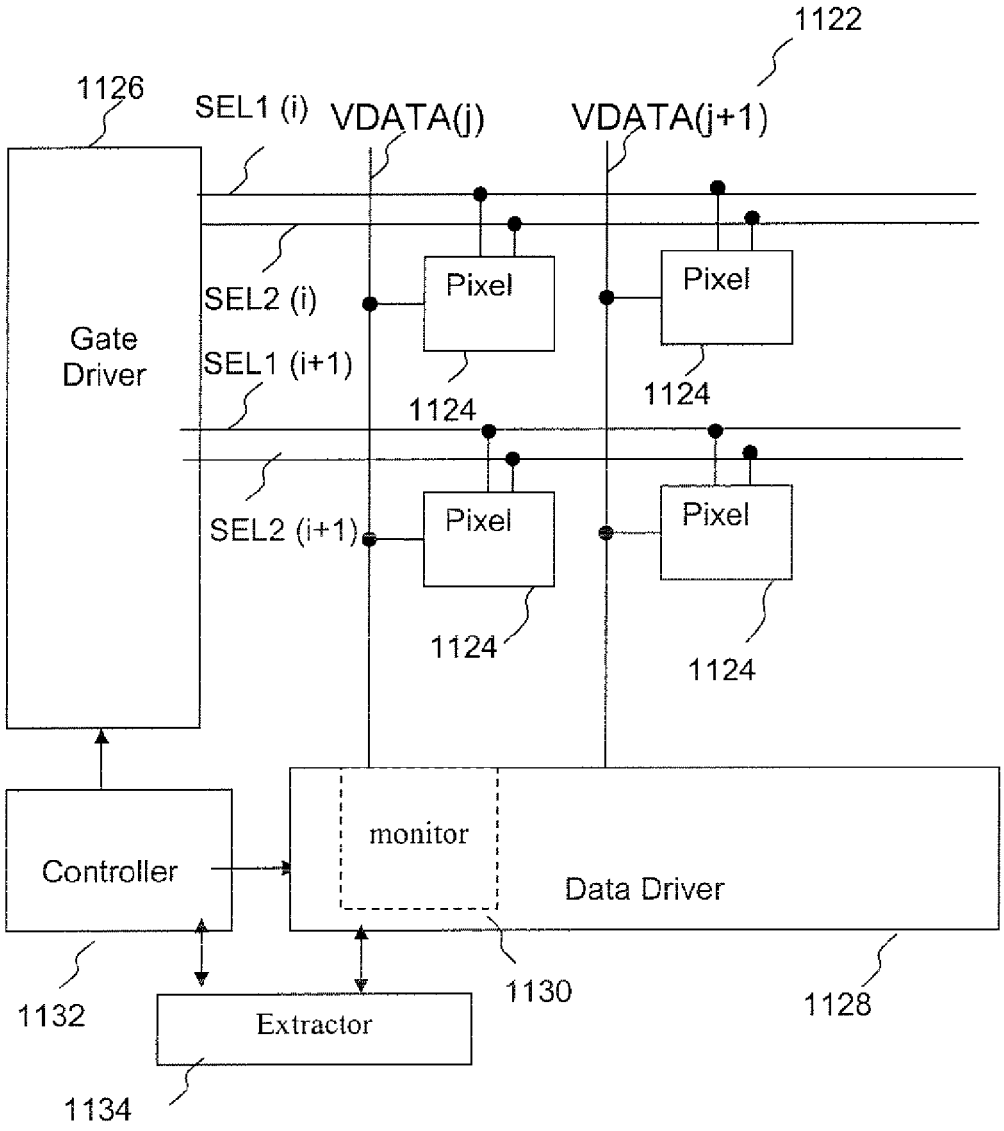
FIG. 29 illustrates an example of a display system having the pixel circuit of FIG. 26 or 27.

FIG. 29 illustrates an example of a display system having the pixel circuit of FIGS. 26 or 27. The display system 1120 of FIG. 29 includes a pixel array having a plurality of pixels 1124 arranged in row and column. In FIG. 29, four pixels 1124 are shown. However, the number of the pixels 1124 may vary in dependence upon the system design, and does not limited to four. The pixel 1024 may be the pixel circuit 260 of FIG. 26 or the pixel circuit 280 of FIG. 27. The pixel array of FIG. 29 is an active matrix light emitting display, and may be an AMOLED display.

SEL1(k) (k=i, i+1) is a first select line for selecting the kth row, and corresponds to SEL1 of FIGS. 26 and 27. SEL2(k) (k=i, i+1) is a second select line for selecting the kth row, and corresponds to SEL2 of FIGS. 26 and 27. VDATA(1) (l=j, j+1) is a data line for the lth column, and corresponds to VDATA of FIGS. 26 and 27.

A gate driver 1126 drives SEL1(k) and SEL2(k). The gate driver 1126 includes an address driver for providing address signals to SEL1(k) and SEL2(k). A data driver 1128 generates a programming data and drives VDATA(1). The data driver 1128 includes a monitor 1130 for driving and monitoring the voltage of VDATA(1). Extractor block 1134 calculates the aging of the pixel based on the voltage generated on VDATA (i). VDATA(1) is appropriately activated for the operations of FIGS. 28A and 28B. VDATA(1) is calibrated using the monitoring result (i.e., the change of VDATA(1)). The monitoring result may be provided to a controller 1132. The data driver 1128, the controller 1132, the extractor 1134 or a combination thereof may include a memory for storing the monitoring result. The controller 1132 controls the drivers 1126 and 1128 and the extractor 1134 to drive the pixels 1124 as described above.

Figure 30:
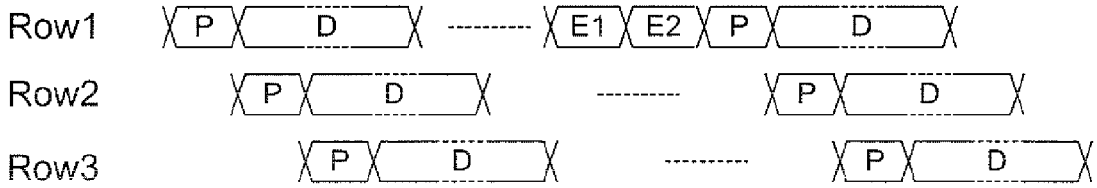
FIG. 30 illustrates an example of normal and extraction cycles for driving the pixel array of FIG. 29.

FIG. 30 illustrates an example of normal and extraction cycles for driving the pixel array of FIG. 29. In FIG. 30, each of ROWi (i=1, 2, . . . ) represents the ith row; "P" represents a programming cycle and corresponds to 310 of FIG. 28B; "D" represents a driving cycle and corresponds to 312 of FIG. 28B; "E1 " represents the first extraction cycle and corresponds to 300 of FIG. 28A; "E2 " represents the second extraction cycle and corresponds to 302 of FIG. 28A. the extraction can happen at the end of each frame during the blanking time. During this time, the aging of several pixels can be extracted. Also, an extra frame can be inserted between several frames in which all pixels are OFF. During this frame, one can extract the aging of several pixels without affecting the image quality.

According to the embodiments of the present invention illustrated in FIGS. 1 to 28B, pixel aging is extracted, and the pixel programming or biasing data is calibrated, which provides a highly accurate operation. According to the embodiments of the present invention, the programming/biasing of a flat panel becomes highly accurate resulting in less error. Thus it facilitates the realization of high-resolution large-are flat panels for displays and sensors.

Programming and reading out technique using shared data lines and select lines is further described in detail using FIG. 31A to 35.

Figure 31A:
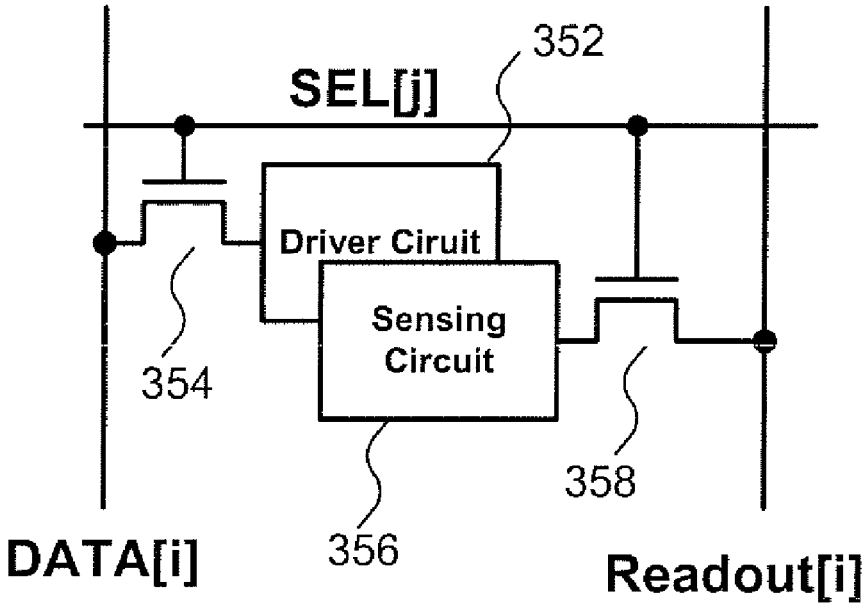
FIG. 31A illustrates a pixel circuit with readout capabilities at the jth row and the ith column.
Figure 31B:
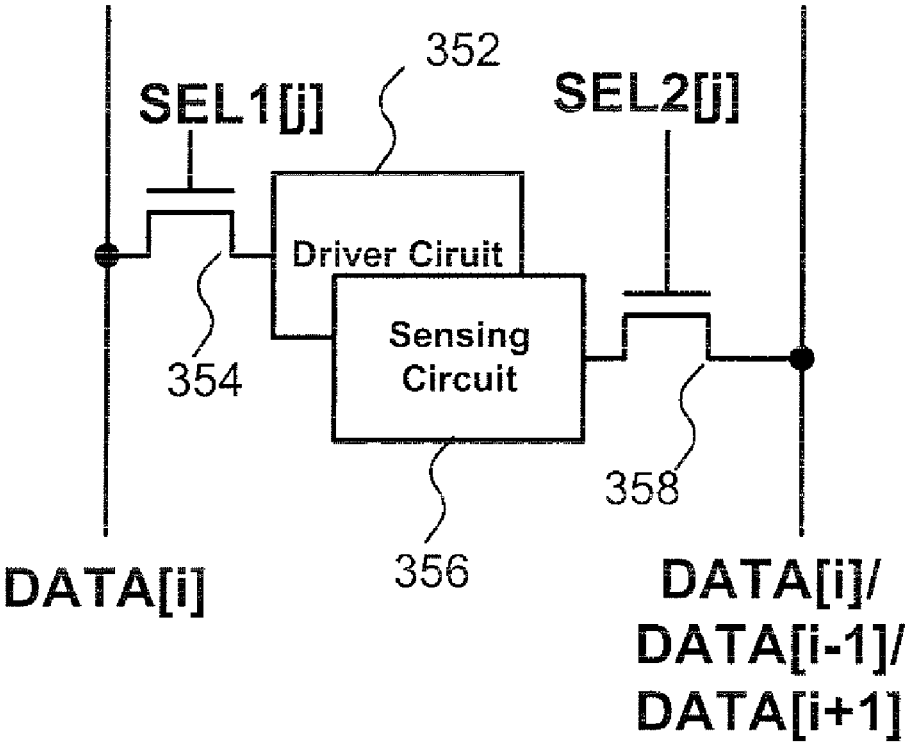
FIG. 31B illustrates another pixel circuit with readout capabilities at the jth row and the ith column.

FIGS. 31A and 31B illustrate pixel circuits with readout capabilities at the jth row and the ith column. The pixel of FIG. 31A includes a driver circuit 352 for driving a light emitting device (e.g., OLED), and a sensing circuit 356 for monitoring an acquisition data from the pixel. A transistor 354 is provided to connect a data line DATA[i] to the driver circuit 352 based on a signal on a select line SEL[j]. A transistor 358 is provided to connect the output from the monitoring circuit 356 to a readout line Readout[i]. In FIG. 31A, the pixel is programmed through the data line DATA[i] via the transistor 354, and the acquisition data is read back through the readout line Readout[i] via the transistor 358.

The sensing circuit 356 may be a sensor, TFT, or OLED itself The system of FIG. 31A uses an extra line (i.e., Readout [i]).

In the pixel of FIG. 31B the transistor 358 is connected to the data line DATA[i] or an adjacent data line, e.g., DATA[i−1], DATA[i+1]. The transistor 354 is selected by a first select line SEL1[i] while the transistor 358 is selected by an extra select line SEL2[i]. In FIG. 31B, the pixel is programmed through the data line DATA[i] via the transistor 354, and the acquisition data is read back through the same data line or a data line for an adjacent row via the transistor 358. Although, the number of rows in a panel is generally less than the number of columns, the system of FIG. 31B uses the extra select lines.

Figure 32:
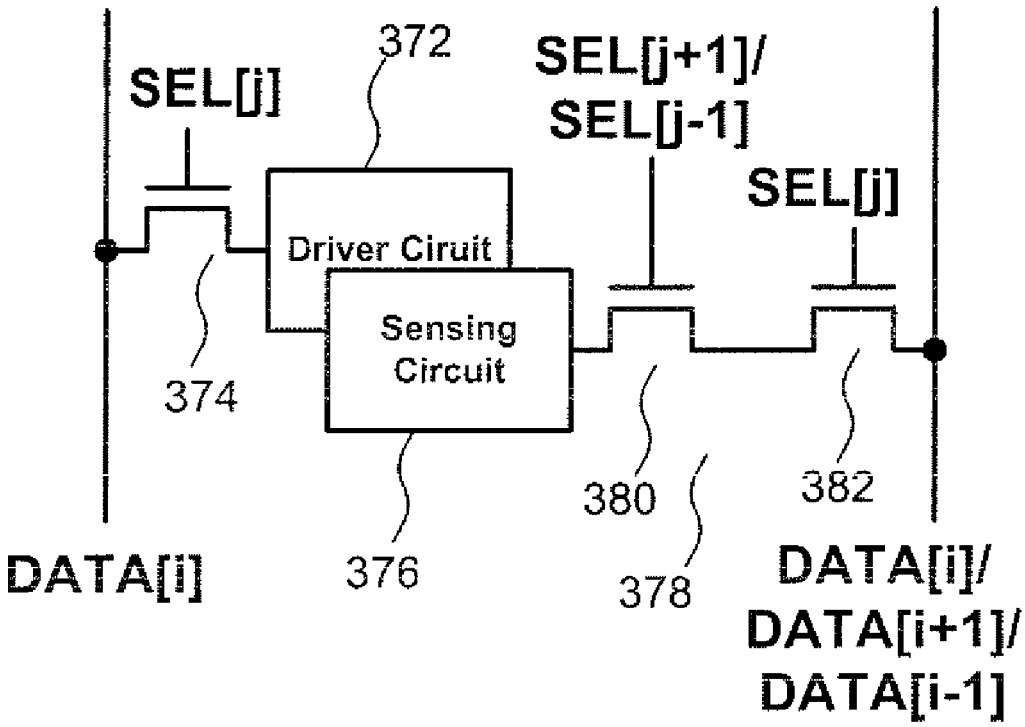
FIG. 32 illustrates an example of a pixel circuit to which a driving technique in accordance with a further embodiment of the present invention is suitably applied.

FIG. 32 illustrates an example of a pixel circuit to which a pixel operation technique in accordance with a further embodiment of the present invention is suitably applied. The pixel circuit 370 of FIG. 32 is at the jth row and ith column. In FIG. 32, the data and readout line are merged without adding extra select line. The pixel circuit 370 of FIG. 32 includes a driver circuit 372 for driving a light emitting device (e.g. OLED), and a sensing circuit 376 for sensing an acquisition data from the pixel. A transistor 374 is provided to connect a data line DATA[i] to the driver circuit 372 based on a signal on a select line SEL[i]. The pixel is programmed while SEL[j] is high. A sensing network 378 is provided to the sensing circuit 376.

The sensing circuit 376 senses the pixel electrical, optical, or temperature signals of the driver circuit 352. Thus, the output of the sensing circuit 376 determines the pixel aging overtime. The monitor circuit 376 may be a sensor, a TFT, a TFT of the pixel, or OLED of the pixel (e.g., 14 of FIG. 1).

In one example, the sensing circuit 376 is connected, via the sensing network 378, to the data line DATA[i] of the column in which the pixel is. In another example, the sensing circuit 376 is connected, via the sensing network 378, a data line for one of the adjacent columns e.g., DATA [i+1], or DATA[i−1].

The sensing network 378 includes transistors 380 and 382. The transistors 380 and 382 are connected in series between the output of the monitor circuit 376 and a data line, e.g., DATA[i], DATA[i−1], DATA[i+1]. The transistor 380 is selected by a select line for an adjacent row, e.g., SEL[i−1], SEL[i+1]. The transistor 382 is selected by the select line SEL[i], which is also connected to the gate terminal of the transistor 374.

The driver circuit 372, the monitor circuit 376, and the switches 3745 380 and 382 may be fabricated in amorphous silicon, poly silicon, organic semiconductor, or CMOS technologies.

Figure 33:
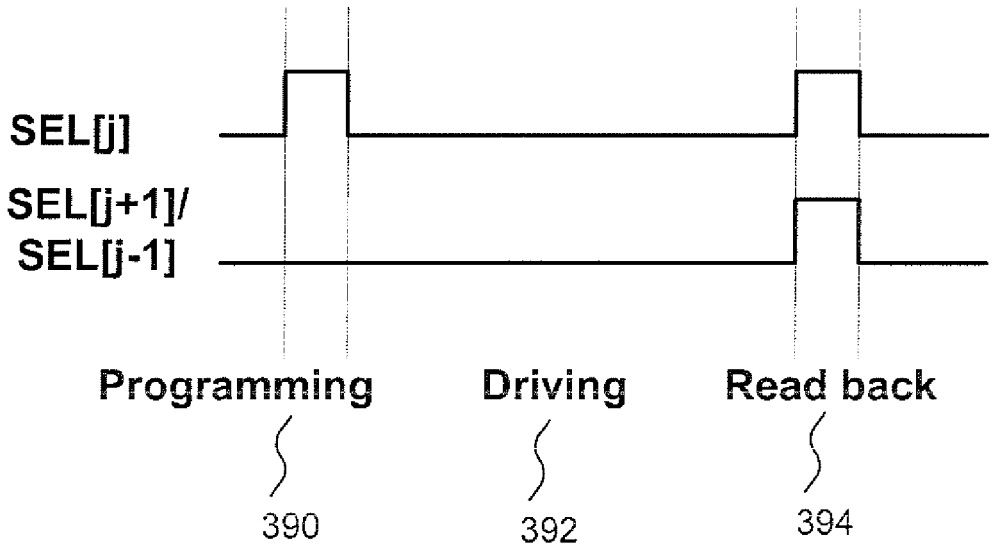
FIG. 33 illustrates an example of signal waveforms applied to the pixel arrangement of FIG. 32.

The arrangement of FIG. 32 can be used with different timing schedule. However, one of them is shown in FIG. 33. The operation cycles of FIG. 33 includes a programming cycle 380, a driving cycle 392, and a readback cycle 394.

Referring to FIGS. 32 and 33, during the programming cycle 390, the pixel is programmed through DATA[i] while SEL[i] is ON During the driving cycle 392, SEL[i] goes OFF. For the readout process 394, SEL[i] and one adjacent row's select line SEL[i−1] or SEL[j+1] are ON, and so the monitoring data is read back through DATA[i], DATA[i−1] or DATA[i+1] which is connected to the sensing network 378.

The transistors 380 and 382 can be easily swapped without affecting the readout process.

Figure 34:
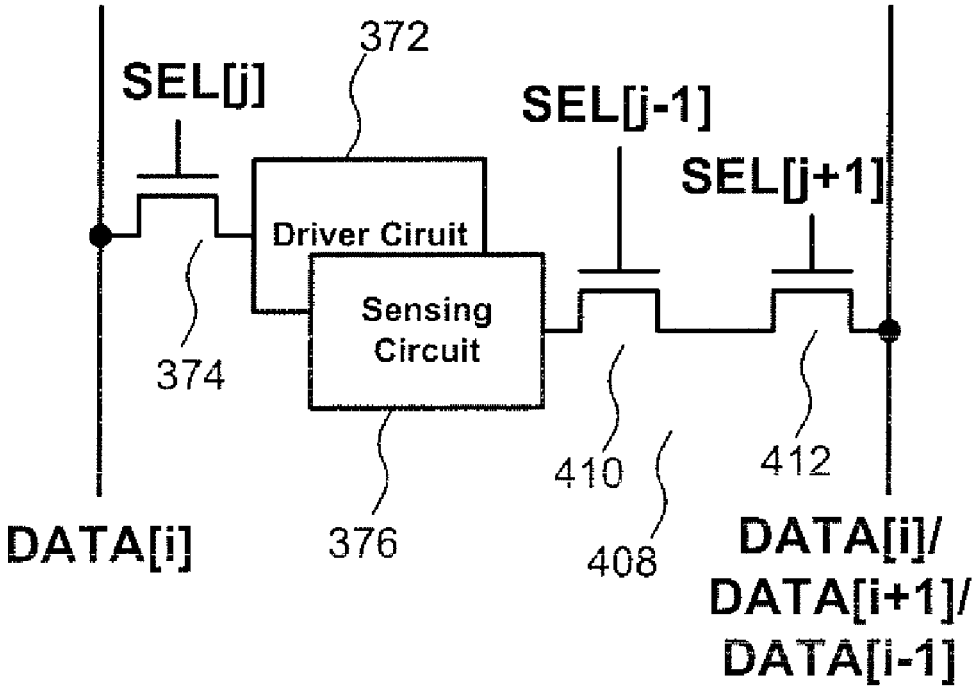
FIG. 34 illustrates another example of a pixel circuit to which the driving technique associated with FIG. 32 is suitably applied.

FIG. 34 illustrates another example of a pixel circuit to which the pixel operation technique associated with FIG. 32 is suitably applied. The pixel circuit 400 of FIG. 34 is at the jth row and ith column. In FIG. 34, the data and readout line are merged without adding extra select line. The pixel circuit 400 of FIG. 34 includes an OLED (now shown), the driver circuit 372, and the sensing circuit 376. A sensing network 408 is provided to the sensing circuit 376. The sensing network 408 includes transistors 410 and 412. The transistor 410 and 412 are same or similar to the transistors 380 and 382 of FIG. 32, respectively. The gate terminal of the transistor 410 is connected to a select line SEL[j−1] for the (j−1)th row. The gate terminal of the transistor 412 is connected to a select line SEL[j+1] for the (j+1)th row. The pixel is programmed while SEL[i] is high. The transistor 412 maybe shared by more than one pixel.

In one example, the monitoring circuit 376 is connected, via the sensing network 408, to the data line DATA[j] of the column in which the pixel is. In another example, the monitoring circuit 376 is connected, via the sensing network 408, a data line for one of the adjacent columns e.g., DATA. [i+1], DATA[i−1].

The switches 410 and 412 can be fabricated in amorphous silicon, poly silicon, organic semiconductor, or CMOS technologies.

Figure 35:
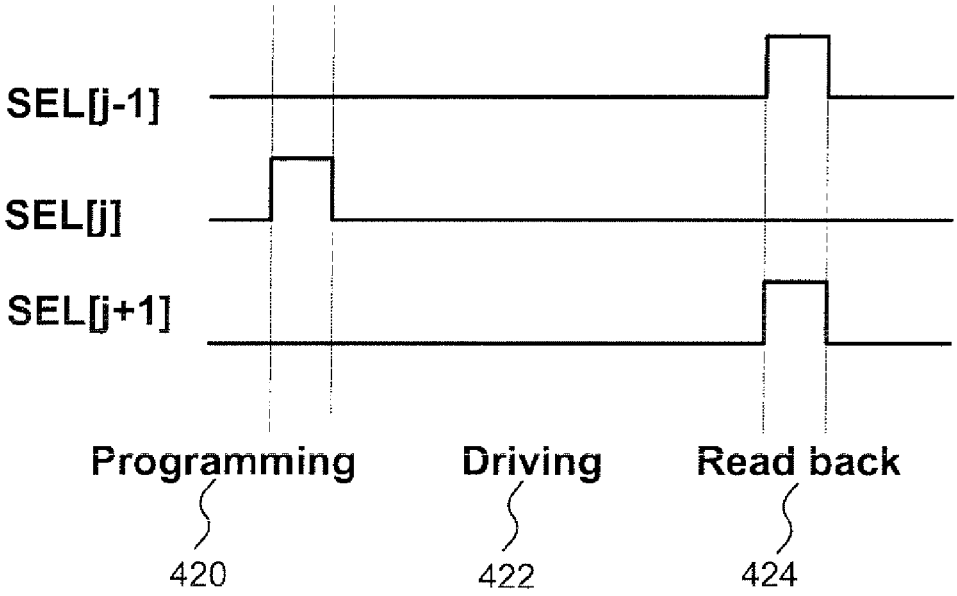
FIG. 35 illustrates an example of signal waveforms applied to the pixel arrangement of FIG. 34.

The arrangement of FIG. 34 can be used with different timing schedule. However, one of them is shown in FIG. 35. The operation cycles of FIG. 35 includes a programming cycle 420, a driving cycle 422, and a readback cycle 424.

Referring to FIGS. 34 and 35, during the programming cycle 420, the pixel is programmed through DATA[i] while SEL[j] is ON During the driving cycle 422, SEL[j] goes Off. For the readout process 424, SEL[j−1] and are ON, and so the monitoring data is read back through DATA[i], DATA[i−1] or DATA[i+1] which is connected to the sensing network 408. The transistors 410 and 412 can hie easily exchanged without affecting the readout process.

The display systems having the pixel structures of FIGS. 31 and 34 are similar to those of the display system described above. Data read back from the sensing network is used to calibrate programming data.

The technique according to the embodiments of the present invention illustrated in FIGS. 32 to 40 shares the data line used to program the pixel circuit and the readout line used to extract the pixel aging data without affecting the pixie circuit operation and without adding extra controlling signal. The number of signals connected to the panel is reduced significantly. Thus the complexity of the driver is reduced. It reduces the implementation cost of the external driver decreases and reduces the cost of calibration tourniquets in active matrix light emitting displays, in particular AMOLED displays.

Figure 36:
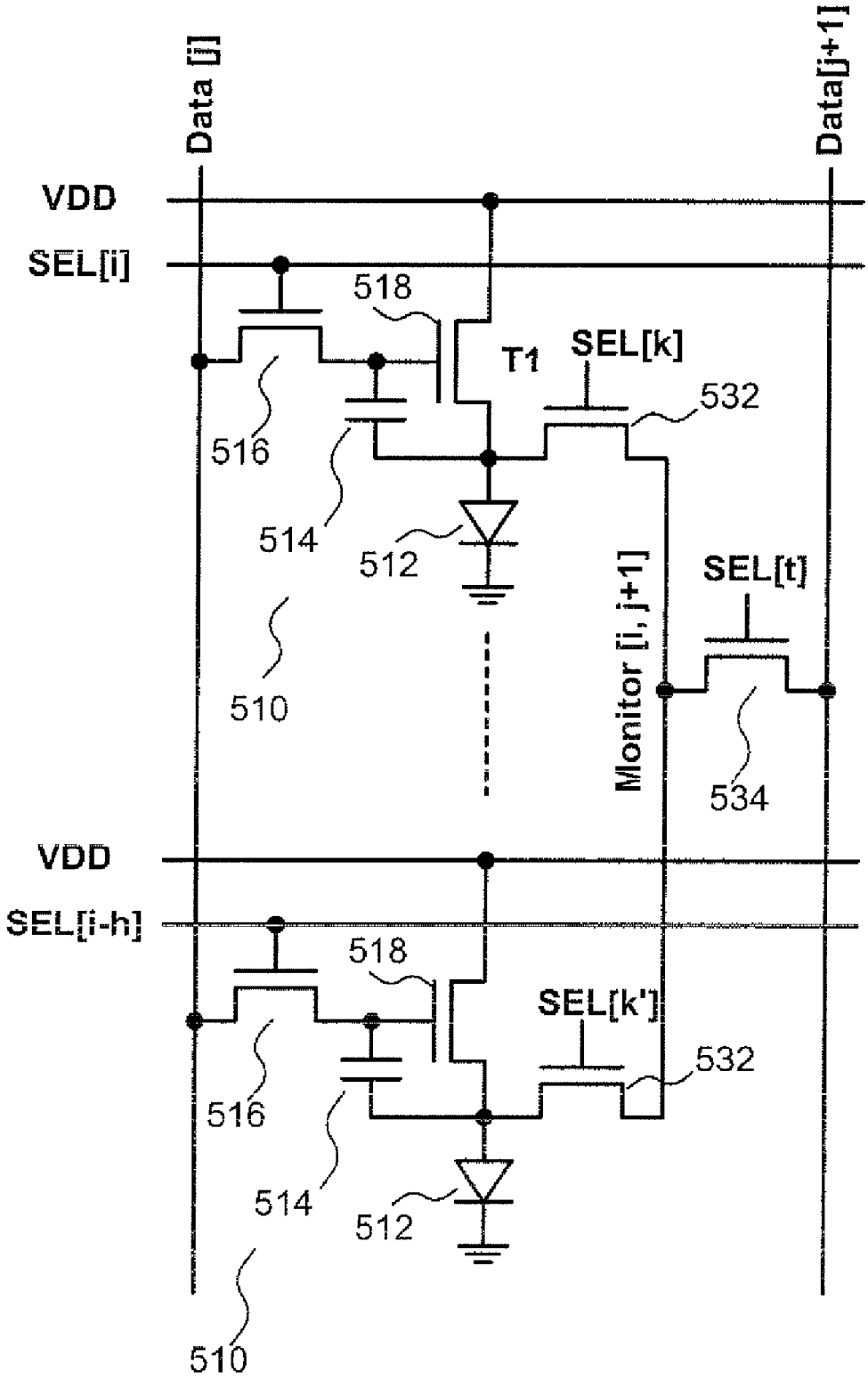
FIG. 36 illustrates an example of a pixel array in accordance with a further embodiment of the present invention.
Figure 37:
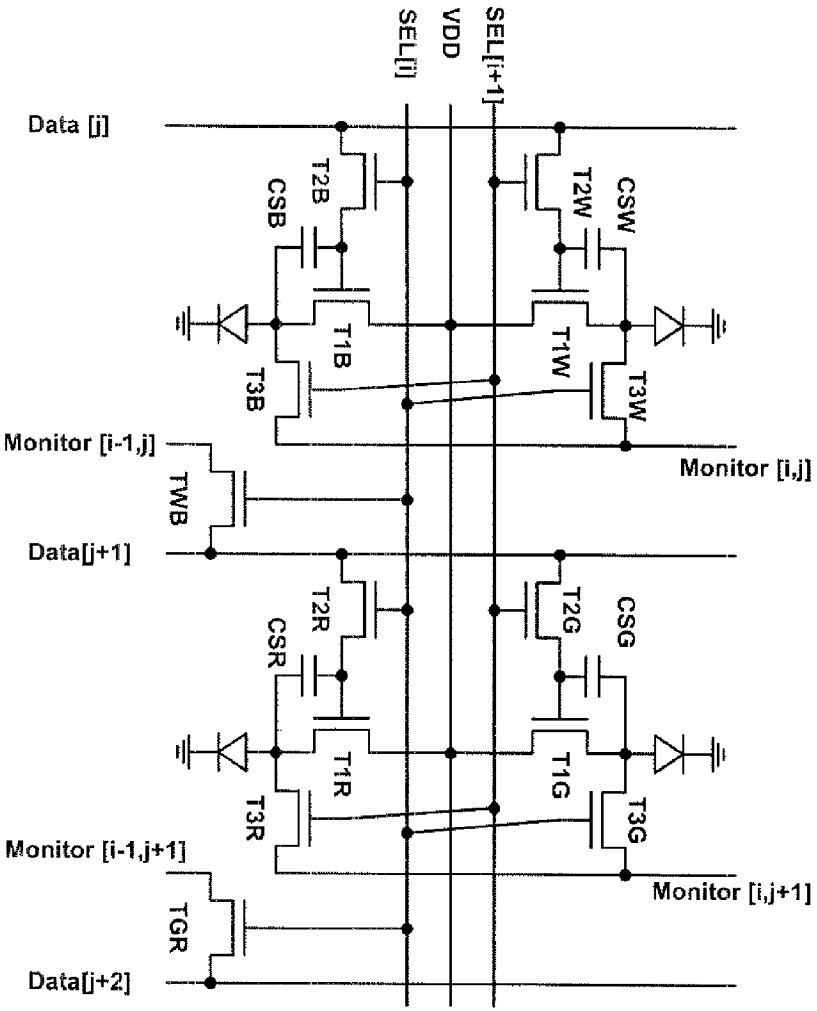
FIG. 37 illustrates RGBW structure using the pixel array of FIG. 36.
Figure 38:
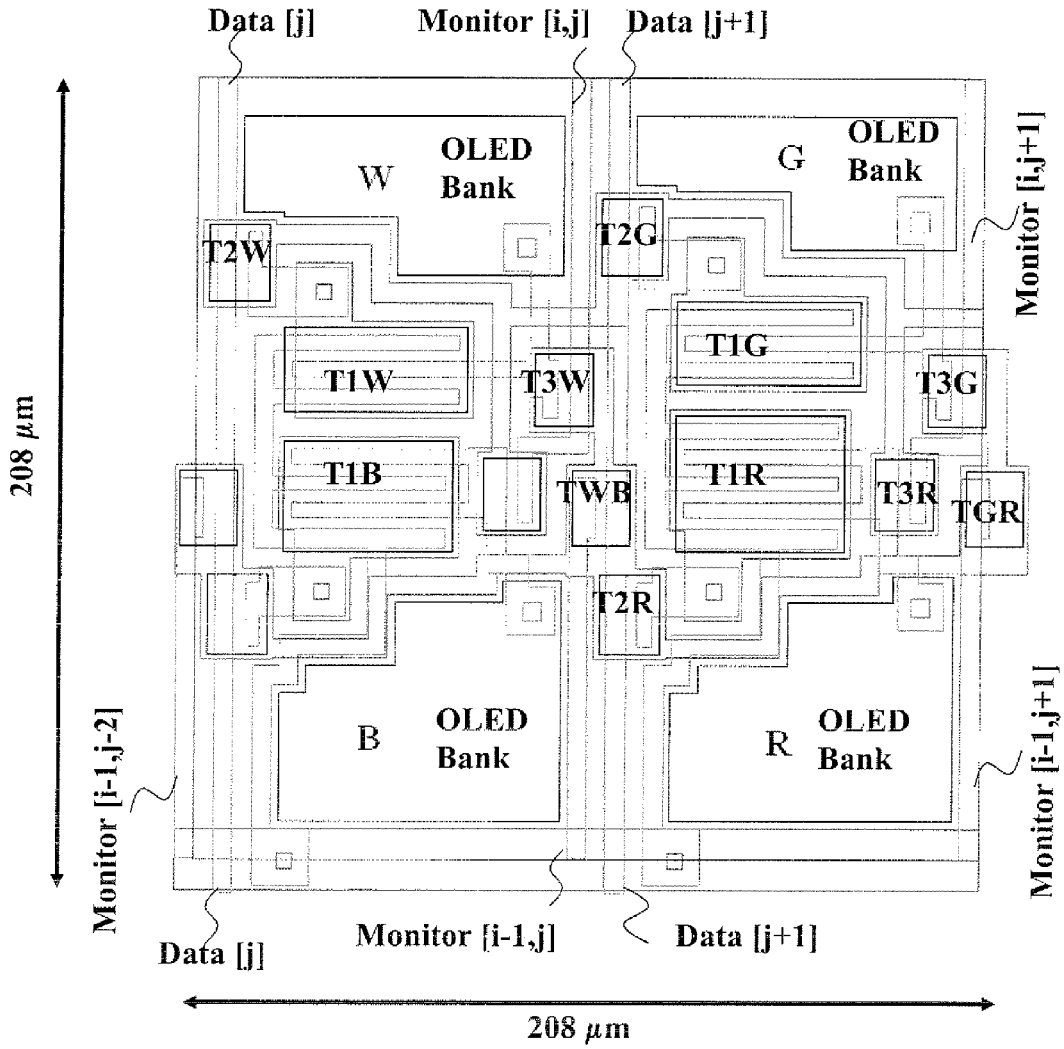
FIG. 38 illustrates a layout for the pixel circuits of FIG. 37.

A technique for increasing the aperture ratio pixel circuits of the calibration techniques is described in detail using FIGS. 36 to 38.

FIG. 36 illustrates an example of a pixel array in accordance with a further embodiment of the present invention. The pixel array 500 of FIG. 36 includes a plurality of pixel circuits 510 arranged in rows and columns. In FIG. 36, two pixels 510 in the jth column are shown. The pixel circuit 510 includes an OLED 512, a storage capacitor 514 a switch transistor 516, and a drive transistor 518. The OLED 512 corresponds to the OLED 212 of FIG. 22. The storage capacitor 514 corresponds to the storage capacitor 214 of FIG. 22. The transistors 516 and 518 correspond to the transistors 216 and 21 of FIG. 22.

The drain terminal of the drive transistor 518 is connected to a power supply line VDD, and the source terminal of the drive transistor 518 is connected to the OLED 512. The switch transistor 516 is connected between a corresponding data line Data [j] and the gate terminal of the drive transistor 518. One terminal of the storage capacitor 514 is connected to the gate terminal of the drive transistor 518, and the other terminal of the storage capacitor 514 is connected to the source terminal of the drive transistor 518 and the OLED 512.

A sensing network 550 is provided to the pixel array 500. The network 550 includes a sensing transistor 532 for each pixel and a sensing transistor 534. The transistor 532 may be included in the pixel 500. The sensing transistor 534 is connected to a plurality of switch transistors 532 for a plurality of pixels 510. In FIG. 36, the sensing transistor 534 is connected to two switch transistors 532 for two pixels 510 in the jth column.

The transistor 532 for the pixel 510 at position (i,j) is connected to a data line DATA [j+1] via the transistor 534, and is also connected to the OLED 512 in the pixel 510 at position (i, j). Similarly, the transistor 532 for the pixel 510 at position (i-h, j) is connected to the data line DATA [+1] via the transistor 534, and is also connected to the OLED 512 in the pixel 510 at position (i-h, j). DATA [j+1] is a data line for programming the (j+1) th column.

The transistor 532 for the pixel 510 at position (i, j) is selected by a select line SEL[k] for the "k"th row. The transistor 532 for the pixel 510 at position (i-h, j) is selected by a select line SEL[k'] for the k' th row. The sensing transistor 534 is selected by a select line SEL[t] for the "t"th row. There can be no relation among "i", "i-h", "k", "k", and "t". However, to have a compact pixel circuit for a higher resolution, it is better that they be consecutive. The two transistors 532 are connected to the transistor 534 through an internal line, i.e., monitor line [j, j+1].

The pixels 510 in one column are divided into few segments (each segments has 'h' number of pixels). In the pixel array 500 of 36, the two pixels in one column are in one segment. A calibration component (e.g., transistor 534) is shared by the two pixels.

In FIG. 36, the pixel at the jth column is programmed through the data line, DATA[j], and the acquisition data is read back through the data line for an adjacent column. e.g., DATA [j+1] (or DATA [j−1]). Since SEL(i) is OFF during programming and during extraction, the switch transistor 516 is OFF. The sensing switch 534 grantees a conflict free readout and programming procedures.

FIG. 37 illustrates RGBW structure using the pixel array 500 of FIG. 36. In FIG. 37, two pixels form one segment. In FIG. 37, "CSR", "T1R", "T2R", and "T3R" are components for a pixel for red "R", and correspond to 514, 518, 516, and 532 of FIG. 36; "CSG", "T1G", "T2G", and "T3G" are components for a pixel for green "G", and correspond to 514, 518, 516, and 532 of FIG. 36; "CSB", "T1B", "T2B", and "T3B" are components for a pixel for blue "B", and correspond to 514, 518, 516, and 532 of FIG. 36; "CSW", "T1W", "T2W", and "T3W" are components for a pixel for white "W", and correspond to 514, 518, 516, and 532 of FIG. 36.

In FIG. 37, "TWB" represents a sensing transistor shared by two pixels for "W" and "B", and corresponds to the sensing transistor 534 of FIG. 36; and "TGR" represents a sensing transistor shared by two pixels for "G" and "R", and corresponds to the sensing transistor 534 of FIG. 36.

The gate terminals of the transistors T3W and T3G are connected to a select line SEL[i] for the ith row. The gate terminals of the transistors T3B and T3R are connected to a select line SEL[i+1] for the ith row. The gate terminal of the sensing transistor TWB and the gate terminal of the sensing transistor TGR are connected to the select line SEL[i] for the ith row.

The sensing transistors TWB and TGR of the two adjacent segments which use the SEL[i] for sensing is put in the segment area of pixels which use SEL [i] for programming to reduce the layout complexity where one segment includes two pixel which shares the same sensing transistor.

FIG. 38 illustrates a layout for the pixel circuits of FIG. 37. In FIG. 45, "R" is an area associated with a pixel for read; "G" is an area associated with a pixel for green;, "B" is an area associated with a pixel for blue; "W" is an area associated with a pixel for white. "TWB" corresponds to the sensing transistor TWB of FIG. 37, and shared by the pixel for while and the pixel for while. "TGR" corresponds to the sensing transistors TGR of FIG. 37, and is shared by the pixel for green and the pixel for red. The size of the pixel is, for example, 208 um×208 um. It shows the applicability of the circuit to a very small pixel for high resolution displays One or more currently preferred embodiments have been described by way of example. It will be apparent to persons skilled in the art that a number of variations and modifications can be made without departing from the scope of the invention as defined in the claims.

What is claimed is:

1. A display system comprising:

multiple pixels arranged in a matrix of rows and columns, each of said pixels having a light emitting device, a drive transistor for driving the light emitting device, and a switch transistor for selecting the pixel; and a power supply line for each of said multiple rows of pixels and coupled to said drive transistor in each of said pixels, multiple select lines for selecting said rows of said pixels in said matrix, multiple data lines for supplying calibration voltages and display data to said columns of pixels in said matrix, a current source for supplying current to the drive transistor of a selected pixel via said power supply line or one of said data lines so that said drive transistor functions as a voltage amplifier to produce an amplified voltage that corresponds to a characteristic of said selected pixel that varies with the age of that pixel, said amplified voltage amplifying any shift in said characteristic of said selected pixel, and circuitry for detecting said amplified voltage and using that detected amplified voltage to determine an adjustment of the calibration voltage for said selected pixel.

2. A display system according to claim 1 which includes a monitoring line and said circuitry includes a sensing network for connecting a path between the light emitting device and the drive transistor to said monitoring line.

3. A display system according to claim 2, wherein the monitoring line comprises a power supply line directly or indirectly connected to the light emitting device or the drive transistor, a data line for providing display data, or an output data line coupled to at least one of the light emitting device and the drive transistor.

4. A display system according to claim 2, wherein the switch transistor of each pixel is selected by a first select line, and wherein the sensing network is activated by a second select line.

5. A display system according to claim 2, wherein the same select line selects the switch transistor and activates the sensing network.

6. A display system according to claim 2, wherein the sensing network comprises a sensing transistor for connecting said path to the monitoring line.

7. A display system according to claim 6, wherein the switch transistor, and the sensing transistor are selected by the same select line.

8. A display system according to claim 2, wherein said sensing network comprises a first sensing transistor and a second sensing transistor for connecting said path to the monitoring line.

9. A display system according to claim 8, wherein the switch transistor is selected by a select line, the first sensing transistor is selected by a second select line, and the second sensing transistor is selected by a third select line.

10. A display system according to claim 8, wherein the first sensing transistor is allocated to each pixel, and wherein the second sensing switch is allocated to more than one first sensing transistor for more than one pixel.

11. A display system according to claim 1 which includes a monitoring line, and wherein each pixel comprises a sensing circuit for monitoring the pixel aging, and wherein said circuitry includes a sensing network for connecting the sensing circuit to said monitoring line.

12. A display system according to claim 11, wherein the sensing network comprises a first sensing transistor and a second sensing transistor for connecting said circuitry to the monitoring line.

13. A display system according to claim 12, wherein the switch transistor is selected by a select line, the first sensing transistor is selected by a second select line, and the second sensing transistor is selected by a third select line.

14. A display system according to claim 1, wherein said pixels form a RGBW pixel array.

15. A display system according to claim 1 which includes a programming line provided to each pixel for providing programming data and monitoring the change of the pixel.

16. A display system according to claim 1, wherein at least a part of the system is fabricated using at least one material selected from the group consisting of amorphous silicon, poly silicon, and nano/micro crystalline silicon, and using at least one technology selected from the group consisting of organic semiconductors technology, TFT, NMOS/PMOS technology, CMOS technology, and MOSFET technology.

17. The display system of claim 1 in which said driver supplies current to a selected row of said pixels at a time when one of the pixels in said selected row is supplied with said calibration voltage.

18. A method of driving a display system comprising multiple pixels arranged in a matrix of rows and columns, each of said pixels having a light emitting device, a drive transistor for driving the light emitting device, and a switch transistor for selecting the pixel, the method comprising selecting rows of said pixels in said matrix, supplying calibration voltages and display data to columns of pixels in said matrix, supplying current to the drive transistor of a selected pixel from a current source via said power supply line or one of said data lines so that said drive transistor functions as a voltage amplifier to produce an amplified voltage that corresponds to a characteristic of said selected pixel that varies with the age of that pixel, said amplified voltage amplifying any shift in said characteristic of said selected pixel, and detecting said amplified voltage and using that detected amplified voltage to determine an adjustment of the calibration voltage for said selected pixel.

19. A display system comprising:

multiple pixels arranged in a matrix of rows and columns, each of said pixels having a light emitting device, a drive transistor for driving the light emitting device, and a switch transistor for selecting the pixel; and a power supply line for each of said multiple rows of pixels and coupled to said drive transistor in each of said pixels, multiple select lines for selecting said rows of said pixels in said matrix, multiple data lines for supplying calibration voltages and display data to said columns of pixels in said matrix, an output data line coupled to at least one of the light emitting device and the drive transistor, a current source for supplying current to the drive transistor of a selected pixel via said output data line so that said drive transistor functions as a voltage amplifier to produce an amplified voltage that corresponds to a characteristic of said selected pixel that varies with the age of that pixel, said amplified voltage amplifying any shift in said characteristic of said selected pixel, and circuitry for detecting said amplified voltage and using that detected amplified voltage to determine an adjustment of the calibration voltage for said selected pixel.

20. The display system of claim 19 which includes a sensing transistor coupling said data output line to a point between said drive transistor and said light emitting device.

* * * * *